United States Patent [19]

Eninger et al.

[11] Patent Number: 4,651,834

[45] Date of Patent: Mar. 24, 1987

[54] ICE PENETRATING METHOD AND APPARATUS

[75] Inventors: James E. Eninger, Torrance; Joseph Miller, Tarzana; Charles K. Murch, Rancho Palos Verdes; Leland A. Ginbey, Lawndale, all of Calif.

[73] Assignee: TRW Inc., Redondo Beach, Calif.

[21] Appl. No.: 765,019

[22] Filed: Aug. 9, 1985

[51] Int. Cl.[4] ..... F25C 5/04

[52] U.S. Cl. ..... 175/18; 299/3

[58] Field of Search ..... 175/11, 17, 18; 299/3

[56] References Cited

U.S. PATENT DOCUMENTS

| | | | |
|---|---|---|---|
| 2,466,773 | 4/1949 | Kestenbaum et al. | 299/3 |
| 3,115,194 | 12/1963 | Adams | 175/11 |
| 4,256,188 | 3/1981 | Hopkins et al. | 299/3 |

FOREIGN PATENT DOCUMENTS

| | | | |
|---|---|---|---|
| 350945 | 9/1972 | U.S.S.R. | 175/18 |
| 0794178 | 1/1981 | U.S.S.R. | 175/18 |

*Primary Examiner*—Stephen J. Novosad
*Assistant Examiner*—William P. Neuder
*Attorney, Agent, or Firm*—Donald R. Nyhagen

[57] ABSTRACT

A thermal ice penetration method and apparatus for melting a hole through ice preferably utilizing thermochemical heating by exothermal reaction between water supplied at least in part by the melting ice and a thermochemical reactant, preferably lithium and/or other alkali metal or alkali metal alloy. A number of ice penetration systems and devices are disclosed which utilize the thermal ice penetration to deploy payloads, such as sensors, transducers, antennas, instruments, weapons, or the like, through polar ice either downwardly from the ice surface into the water below the ice or upwardly from the underside of the ice through the ice surface.

82 Claims, 31 Drawing Figures

ICE PENETRATING METHOD AND APPARATUS

FIELD OF THE INVENTION

This invention relates generally to the art of penetrating ice and more particularly to a novel thermal ice-penetration method and apparatus for melting a hole through ice, particularly polar ice. The invention relates also to ice penetrating deployment systems and devices for deploying payloads, such as transducers, antennas, weapons or the like either downwardly through polar ice from its surface into water below the ice or upwardly from the underside of the ice through its surface.

Prior Art

Many polar activities require penetration of polar ice, such as an ice floe, to create a hole through the ice and/or deploy a payload through the ice into water below the ice or upwardly through the ice to its surface or into the atmosphere. A variety of ice-penetration methods and devices for this purpose have been devised. Most of these of which we are aware are essentially mechanical devices suitable only for downward ice penetration and include hot-water drills, electrically heated penetrators, shaped explosive charges, kinetic-energy projectiles, rotary ice-boring machines, and ice-cutting devices.

These prior ice penetration devices have many disadvantages. Their major disadvantages are their large size and weight, not only of the ice penetration devices themselves but of the power supplies necessary to power the devices. If these power supplies are or include fuel-powered prime movers, there exists the additional problem of providing and storing the fuel required for their operation. Because of their large size and weight, the existing ice penetrators are difficult to transport and difficult or impossible to airdrop onto the ice. They generally require the presence of an operator or attendant and often produce much sound or vibration which may be a serious problem in some cases. These existing ice penetration devices are also costly to manufacture, difficult to maintain, and are limited to downward ice penetration.

Canadian Pat. No. 969,168 discloses a thermochemical ice penetration method and apparatus which utilize the heat generated by a thermochemical reaction to melt a hole through ice. One reactant of this reaction is water which is at least partially supplied by the ice as it melts. The other reactant is a thermochemical material which reacts exothermally with water and is typically an alkali metal or an alloy containing an alkali metal, preferably lithium. While it avoids most of the above noted disadvantages of the existing ice penetration devices, the thermochemical ice penetration apparatus of the Canadian Patent has other deficiencies which severely restrict its use. Among the foremost of these deficiencies is its spherical shape which tends to cause the penetrator to be much larger than it needs to be to deliver its payload through the ice. The penetrator is also limited to downward ice penetration.

Accordingly, there is a need for improved ice penetration devices and methods which do not possess the above and other disadvantages of the the existing ice penetrators. In this regard, for example, it is significant to note that the Navy has an immediate need for both downward and upward polar ice penetrators that will silently penetrate up to ten feet or more of polar sea ice and, if desired, deploy objects such as torpedoes, mines, antennas, acoustic decoys and the like through the ice.

SUMMARY OF THE INVENTION

According to its broader aspects, this invention provides an improved thermal ice penetration method and apparatus which may be utilized to penetrate ice in either an upward or downward direction. Some of the disclosed embodiments of the invention, for example, are for deployment of instruments, transducers, weapons or the like downwardly through polar ice into water below the ice. Other disclosed embodiments are for deployment of an antenna from a submarine submerged below polar ice upwardly through the ice to position above the ice surface.

Generally stated, the thermal ice penetrating device of the invention is characterized by an elongate body having a thermogenic end portion or tip, that is a heat producing tip, which is referred to herein as a thermal ice penetrator or simply an ice penetrator. This ice penetration device is urged, tip or ice penetrator first, against the ice to be penetrated to melt a hole through the ice. Downward ice penetrators utilize gravity as the penetration force for urging the penetrator against the ice. Upward ice penetrators utilize water buoyancy as the penetration force. The invention contemplates thermochemical generation of the heat required for ice penetration. In context of this invention, thermochemical heat generation involves an exothermal chemical reaction between water furnished at least in part by melting ice and the thermogenic tip or ice penetrator which is composed of a thermochemical material that reacts exothermally with water. This thermochemical material is typically an alkali metal or an alloy containing an alkali metal. The preferred alkali metal is lithium. A unique and important advantage of an upward ice penetrator which utilizes a thermochemical reactant such as Lithium resides in the fact that the thermochemical-water reaction generates a gas (hydrogen) which prevents sea water from flooding the ice hole and thereby disipating the heat generated by the thermochemical reaction. This exclusion of sea water from the ice hold thus results in a substantial increase in the ice penetration rate.

With regard to thermochemical heat generation for ice penetration, lithium is preferable to other alkali metals as the primary heat generating thermochemical reactant because it has these several attractive properties:

1. Lithium has a high heat release per unit volume and such heat release per unit volume is superior to sodium and potassium.
2. Unlike sodium and potassium, lithium is safe to handle and transport, and does not ignite when exposed to air or water.
3. The reaction rate of lithium with near freezing water is sufficient to penetrate ice at practical speeds on the order of 2–5 centimeters per minute.
4. Lithium is readily cast or forged into required shapes.
5. Lithium is low in cost, at the present time approximately $44 per kilogram, and readily available.

Contrasted with these advantages of lithium, however, is the fact that its density is half that of water. As a consequence, when penetrating ice in a downward direction, an ingot of pure lithium will penetrate ice only to a very shallow depth since it will float on the water produced as the ice melts. Downward penetration of lithium through ice thus requires supplementing the gravitational force on the lithium, as by weighting the lithium with ballast sufficient to overcome the upward buoyant force on the lithium and maintaining the latter near or in contact with the ice. While the preferred thermochemical reactant is lithium or a lithium alloy, the invention contemplates the use of other thermochemical reactants, particularly in combination with lithium. In use, the thermochemical ice penetrator is urged longitudinally against the ice to maintain a reaction surface on the penetrator in firm contact with the ice. The thermochemical material of the penetrator reacts exothermically with water at the interface between the reaction surface and the ice to generate heat which melts the ice adjacent the interface.

Several presently preferred thermal ice penetrators according to the invention are disclosed. Some of these are downward ice penetrators which enter the ice surface and penetrate downwardly through the ice. These penetrators require sufficient downward force on the penetrator body to maintain the thermochemical penetrator tip in contact with the ice. In one disclosed downward ice penetrator, this downward force is exerted by external means, specifically by an operator pushing downwardly on the penetrator. In other disclosed downward ice penetrators, the penetrator body is weighted with ballast to provide the required downward force. This ballast may be either or both a simple ballast weight and/or a payload. These disclosed downward ice penetrators are embodied in ice penetrating payload deployment systems for deploying payloads, such as instruments acoustic decoys, sonar sensors, or hydrophones, or weapons, such as torpedoes or explosive mines, through polar ice into the water below the ice.

Various means and procedures are disclosed for placing the downward ice penetration devices and systems on, and orienting the penetration devices in the proper upright position relative to the surface ice. The manually operated ice penetrator, for example, is placed on the ice and held in the proper position by an operator. Another disclosed downward ice penetrator is placed manually on the ice surface in the proper upright ice penetrating position and then remains in this position as it descends through the ice. Other downward ice penetration devices are disclosed which are landed by parachute or cable on the ice from an airplane or helicopter and embody penetrator reorienting means for reorienting the devices to the proper upright position from an initial horizontal position on the ice surface. Another disclosed downward ice penetration device includes a guide for retaining the device in the proper upright position during its initial ice penetration phase.

One important feature of the invention resides in the elongate shape of the ice penetrator which tends to guide the latter along a relatively straight path through the ice. In other words, the elongate shape of the penetrator provides a guidance means which tends to guide the penetrator along a relatively straight path through the ice. According to another unique and important feature of the invention, the penetrator may mount trailing resilient blades or arms which bear resiliently against the wall of the ice hold behind the penetrator body to provide additional guidance and stabilizing means for guiding tne penetrator along a relatively straight path through the ice. In certain disclosed embodiments of the invention, these spring arms or blades also provide the penetrator reorienting action mentioned above. Embodiments are also disclosed which utilize the thermogenic end portion of the ice penetrator to effect or assist such penetrator reorientation.

Other disclosed thermal ice penetration devices of the invention are designed to be launched from a submarine submerged below polar sea ice, such as a polar ice floe, and to penetrate upwardly through the ice either partly or all the way to its surface. The required upward penetration force is provided by flotation means, aided in some cases by extension means for extending the ice penetrator upwardly relative to the flotation means. These disclosed upward ice penetration devices are ice penetrating submarine antenna deployment devices for penetrating upwardly through polar ice to deploy a submarine antenna above the ice surface for communication between the submerged submarine and a remote communication station.

If the temperatures of both the thermochemical reactant of a thermochemical ice penetrator and the ice to be penetrated are well below freezing, the initial reaction rate may be too low to bring the temperature of the penetrator to operational level. The invention provides solutions to this problem. The invention also contemplates the combination of lithium with other more reactive thermochemical reactants, such as sodium, to initiate and/or accelerate the exothermal reaction of the thermochemical penetrator.

The invention will now be described in more detail by reference to the accompanying drawings, wherein.

DESCRIPTION OF THE PREFERRED EMBODIMENT

As noted earlier, thermochemical ice penetration according to this invention involves the utilization of heat produced by the exothermic reaction between water and a thermochemical reactant to melt a hole through ice. The preferred thermo-chemical reactant is lithium or a lithium alloy. Accordingly, it is well to consider at the outset the lithium-water reaction.

The lithium-water reaction is:

$$2\,H_2O + 2Li — 2LiOH + H_2 + 112\text{ kcal}$$

The reaction of one kilogram of lithium releases 8000 kcal of heat, which is sufficient to melt 77kg of −50 C ice (1900 kcal to warm it to 0 C and 6100 kcal to change its state). As an example of lithium's effectiveness in penetrating ice, a 10-cm-diameter hole 3-meters deep requires 300 g of lithium, assuming 100% of theoretical efficiency.

The lithium/water reaction typically occurs 10° to 50° C. above the freezing point. It is this factor that primarily sets the penetration speed. The force per unit area of the lithium against the ice has a secondary effect. Penetration speeds in the range of 2 to 30 cm/min have been measured. At 5 cm/min, for example, it takes an hour to penetrate 3 meters of ice. The penetration speed can be increased by alloying the lithium with sodium or other reactant in such a way as to combine the high heat release and safe handling properties of lithium with the high reaction rates of the additive.

Figure 1:
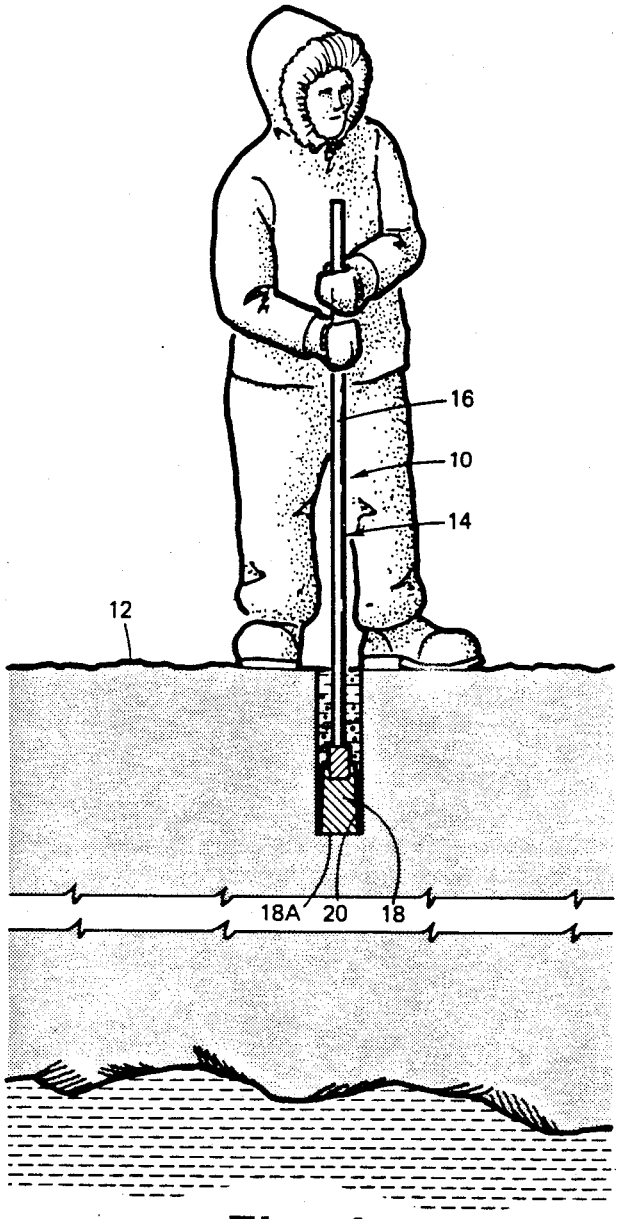
FIG. 1 illustrates a simple manually operated thermochemical ice penetrator according to the invention.

Turning now to FIG. 1, there is illustrated a thermochemical ice penetration device 10 according to the invention for penetrating ice 12 in the downward direction. The device has an elongate body 14 including a rear portion 16 and a front end heat generating or thermogenic end portion or tip 18 referred to herein as a thermal ice penetrator or simply an ice penetrator. The material of this ice penetrator is a thermochemical material which reacts exothermally with water to generate the heat necessary to penetrate the ice 12. For the reasons explained earlier, the preferred thermochemical material is lithium or a lithium alloy. The ice penetrator end portion 18 has a front, longitudinally facing reaction surface 18A for contacting the ice.

In use, the ice penetration device 10 is placed upright on the ice 12 with its thermochemical reaction surface 18A lowermost and in contact with the ice. Assuming there is sufficient water at the interface between the ice and the reaction surface or that initial contact of the penetrator 18 with the ice produces sufficient water at the interface by melting the ice, the lithium or other thermochemical material of the penetrator reacts exothermally with the water. The heat generated by this reaction melts the ice to produce more water which then reacts with the lithium. The exothermal reaction thus continues, and the ice penetrator 18 gradually melts a hole 20 through the ice.

It is evident that as the ice penetration process continues, the ice hole 20 will soon fill with water to a depth sufficient to submerge the ice penetrator 18, as shown in FIG. 1. Assuming that the penetrator is made of lithium or an alloy containing lithium, which has a density about one half that of water, the water in the ice hole will produce an upward buoyant force on the penetrator which must be counteracted to maintain the latter in contact with the ice.

The particular ice penetration device shown in FIG. 1 is a manual, thermochemical ice penetrator which is held in an upright position by an operator who may also apply to the penetrator some or essentially all of the downward force required to maintain the penetrator 18 in contact with the ice. To this end, the rear portion 16 of the penetrator body 14 is a long pole-like handle to be gripped by the operator, as shown. The penetrator 18 is firmly attached to the normally lower end of the pole handle and is conically tapered so as to increase slightly in diameter toward its normally lower leading end.

In use, the operator grips the penetrator handle 16 and positions the penetrator upright with its reaction surface 18A in contact with ice. The ice penetrator must be held in an upright position at least until the ice has been penetrated sufficiently to hold the penetrator upright. Then, if the penetrator handle 16 is weighted to provide ballast for the ice penetrator 18, the operator may release the penetration device which will continue to melt its way through the ice, the long handle of the device serving to guide the penetrator along a relatively straight path through the ice. This procedure may be utilized to form holes to any desired depth in the ice.

The heat generated by the exothermic reaction of the ice penetrator 18 with the water in the ice hole 20 may be sufficient to prevent refreezing of the water in the hole above the penetrator. The lower the temperature and/or the greater the depth of the ice hole, of course, the greater will be the possibility of refreezing of the water in the hole. If necessary, refreezing could be prevented by pumping water from the ice hole, exposing additional thermochemical reactant to the water in the hole above the penetrator 18, or in any other convenient way.

Reference is now made to FIGS. 2–5 illustrating a modified thermochemical ice penetration device 30 according to the invention and a system 32 utilizing a plurality of the devices for deploying instruments 34 into the water 36 below an ice floe 38. Each ice penetration device 30 is associated with an instrument 34, and the associated penetration devices and instruments are connected by cables 40 to a battery or solar powered signal processor 42. As will appear from the ensuing description, the invention may be utilized to thus deploy a variety of instruments, such as acoustic sensors, acoustic decoys, underwater signal transmitters, sonar sensors, and the like. The particular instruments 34 illustrated are hydrophones, and the signal processor 42 is a transmitter with an antenna 43 for transmitting signals to a remote monitoring station in response to underwater sound detection by the hydrophones. These transmitted signals may represent various kinds of information. For example, the transmitted signals may represent the actual underwater sounds detected by the hydrophones or the directions of the sounds, or the transmitted signals may be prerecorded signals which are transmitted in response to underwater sound detection by the hydrophones.

As will appear from the ensuing description, the hydrophones 34 may be embodied directly in the ice penetration devices 30. In the particular ice penetrating hydrophone deployment system illustrated, however, the hydrophones are separated from the penetration devices to permit greater latitude in the design of both.

Figure 3:
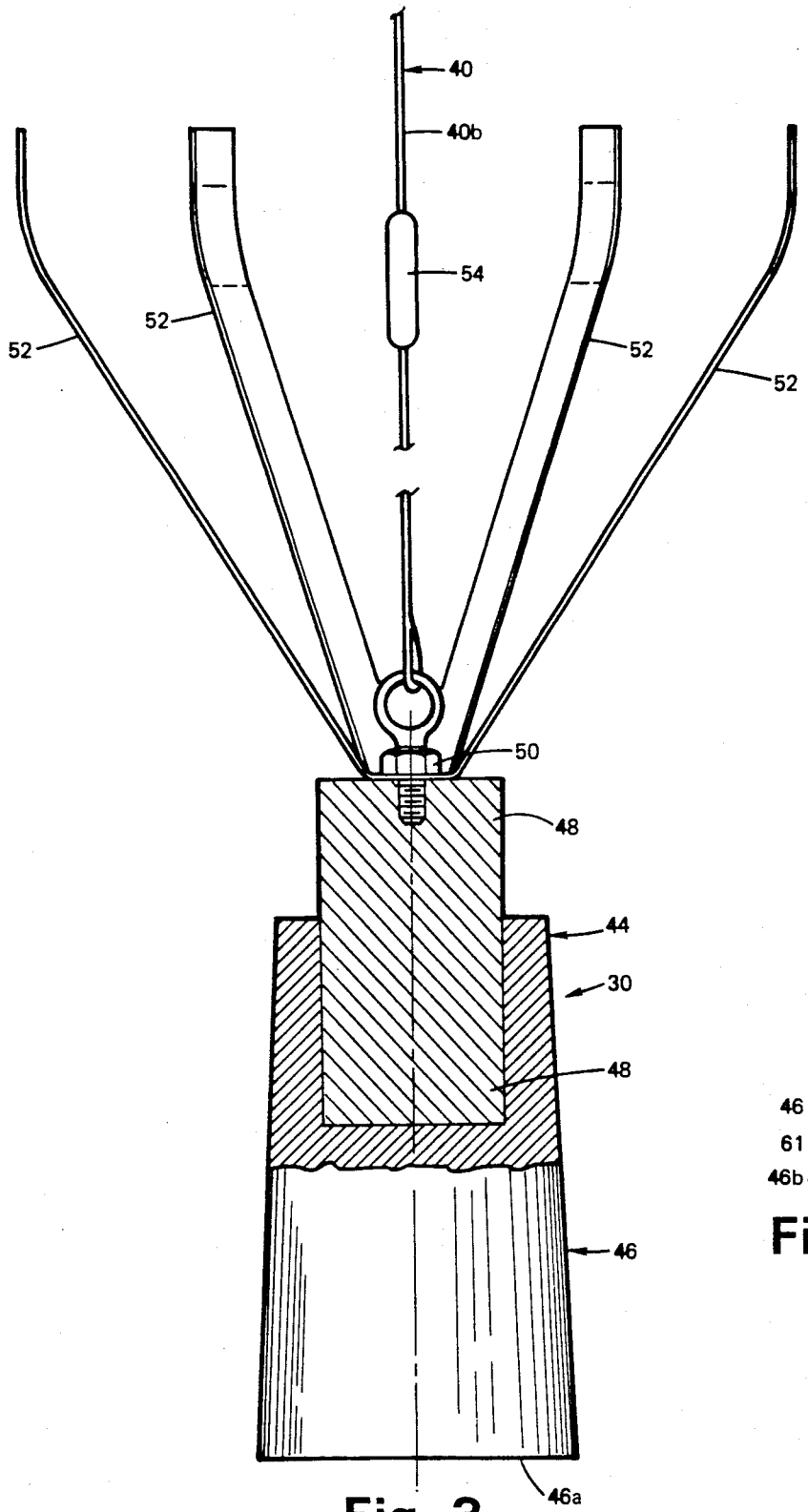
FIG. 3 is a side elevation, partly in section, of one gravitational thermochemical ice penetrator in FIG. 2.

FIG. 3 illustrates one of the thermochemical ice penetration devices 30 in enlarged detail. This device comprises an elongate body 44 having a normally lower thermogenic end portion or ice penetrator 46 composed of thermochemical material, preferably lithium or a lithium alloy, which reacts exothermically with water. The rear end of the penetrator body 44 is a ballast 48 which is firmly embedded in and joined to the ice penetrator 46. The mass of this ballast is such that the overall density of the body is sufficiently greater than the density of water to maintain the penetrator 46 in contact with the ice during ice penetration, as explained below. The ice penetrator 46 has a longitudinally facing reaction surface **46*a*** at its normally lower leading end and is preferably circular in cross section and tapered slightly with an increasing diameter toward its leading end, as shown.

Firmly attached by a bolt 50 or the like to the rear end of the ballast 48 are spring blades or arms 52 which aid in guiding the ice penetration device 30 along a straight path through the ice, as explained below. These arms are uniformly spaced about the longitudinal axis of the body 44 and extend a substantial distance rearwardly of the body. In their normal unstressed state, shown in FIG. 3, the arms diverge outwardly from the body axis throughout most of their length. The rear free extremities of the arms curve inwardly slightly, as shown. When the spring arms 52 occupy their normal unstresses positions of FIG. 3, their rear extremities are substantially equally radially spaced from the longitudinal axis of the ice penetrator body 44 a distance substantially greater than the radius of the larger leading end of the ice penetrator 46.

Each cable 40 includes a cable section **40*a* mechanically and electrically connecting the respective acoustic processor or transmitter 42 and the acoustic transducer or hydrophone 34 and a cable section 40*b* mechanically connecting the respective hydrophone and ice penetration device 30. Cable section 40*a* is a combined mechanical and electrical cable for supporting tension loads and transmitting electrical signals between the hydrophone 34 and the transmitter 42. Cable section 40*b* is a mechanical load supporting cable only. According to the preferred practice of the invention, cable section 40*b* includes a means 54, such as a water soluable link, for releasing the corresponding ice penetration device 30 from the cable 40 following deployment of the hydrophone 34 below the ice 38**.

Figure 4:
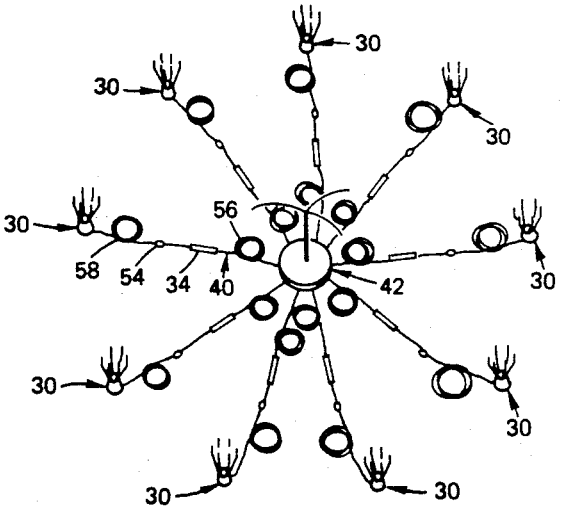
FIG. 4 is a plan view, on reduced scale, of the ice penetrating deployment system of FIG. 2.

In use, the hydrophone deployment system 32 is manually placed on the surface of the ice 38 with the ice penetration devices 30 arrayed in any desired hydrophone deployment pattern about the transmitter 42. FIG. 4 illustrates the devices arrayed in a generally circular pattern about the transmitter. The ice penetration devices are placed upright on the ice with their normally lower reaction surfaces **46*a*** in contact with the ice. The transmitter is firmly anchored to the ice.

The length of each cable section **40*a* is made equal to the sum of the radial distance from the transmitter 42 to the surface location of the corresponding ice penetration device 30, the ice thickness below this surface location, and the desired deployed depth of the corresponding hydrophone 34 below the ice. For reasons which will appear presently, the length of each cable section 40*b*** is preferably a few feet greater than the latter ice thickness.

From the description of the cable lengths, it is evident that when the ice penetration devices 30 occupy their initial positions on the surface of the ice 38, there will be a substantial length of cable between each device and the transmitter 42. Preferably, each cable 40 is organized by winding the cable section **40*a* into a first coil 56 and winding the cable section 40*b* into a second coil 58**.

Figure 2:
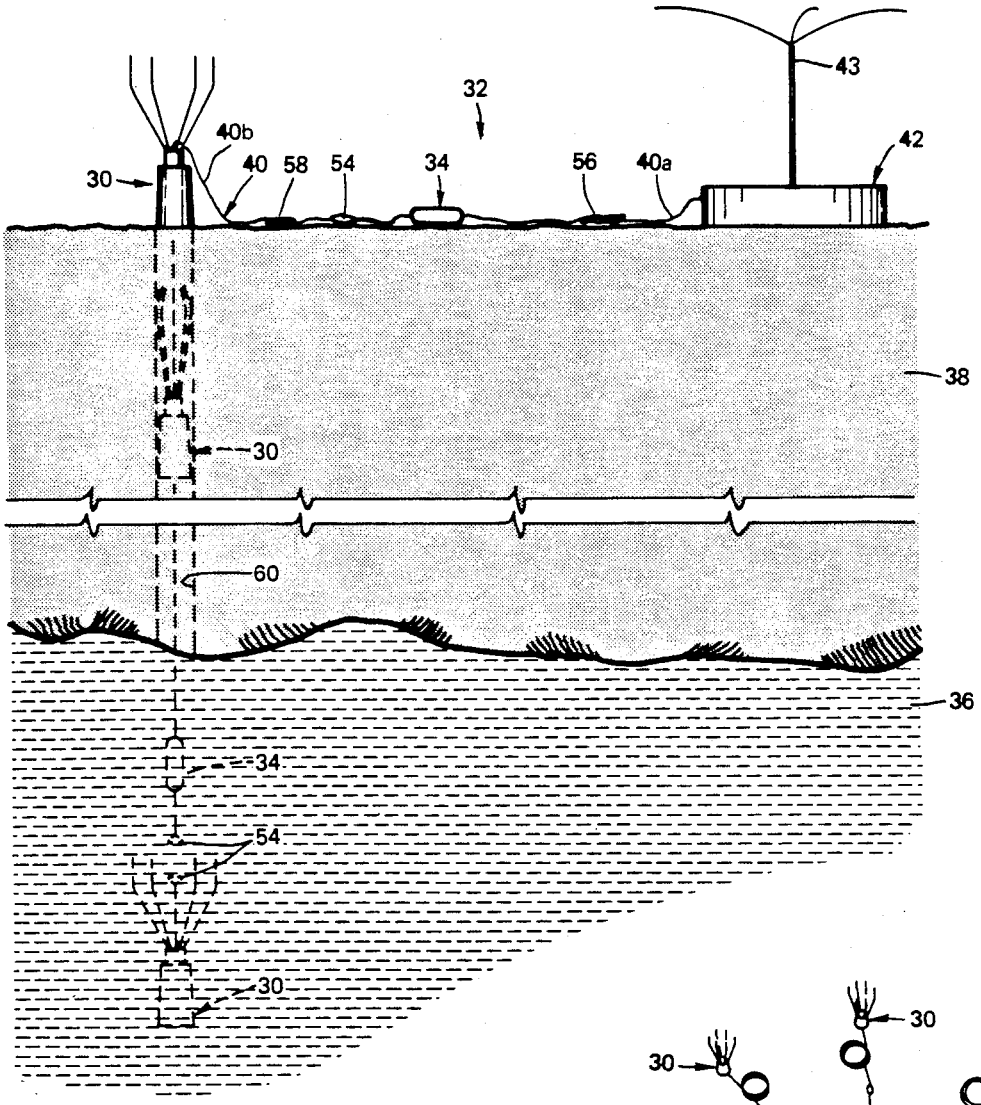
FIG. 2 illustrates an ice penetrating transducer deployment system according to the invention utilizing a gravitational thermochemical ice penetrator for deploying acoustic transducers into the water below a polar ice floe.

After placement of the hydrophone deployment system on the ice 38, the system may be left unattended, and further system deployment and operation will occur automatically. FIG. 2 illustrates the deployment sequence of one hydrophone. This deployment sequence is essentially the same for all the hydrophones. The first event in this sequence is penetration of the ice 38 by the corresponding ice penetration device 30. In this regard, it is assumed that enough water initially exists at the interface between the reaction surface **46*a* of each ice penetrator 46 and the ice 38 to effect exothermic reaction of its thermochemical reactant with the water at a rate sufficient to melt the ice and thereby continue the reaction. As noted earlier and discussed in more detail later, a feature of the invention is concerned with providing sufficient initial water at the interface to effect the exothermic reaction at the rate necessary to melt the ice. Accordingly, each ice penetrator will commence to melt its way downwardly through the ice 38 and produce a hole 60** through the ice.

Eventually, each ice penetration device 30 will become submerged in water produced in the ice hole 60 by the melting ice. As noted earlier, each device is weighted by its ballast 48 to have an overall density sufficiently greater than water to maintain the penetrator reaction surface 46*a* in contact with the ice against the opposing upward buoyant force on the lithium or other low density thermochemical reactant used in the penetrator. Thus, each ice penetration device will continue to melt its way downwardly through the ice under the action of gravity even after it becomes submerged in water.

As noted earlier and shown in the drawings, the thermal ice penetrator 46 of each ice penetration device 30 is tapered with an increasing diameter toward its lower leading end, such that its diameter in any given transverse plane exceeds the diameter of the penetrator body 44 in every other transverse plane of the body rearwardly of the given plane. Accordingly, radial clearance will exist between the wall of each ice hole 60 and the respective ice penetrator body except at the leading end of the penetrator 46 to assure free passage of the penetration device through the hole.

Figure 3A:
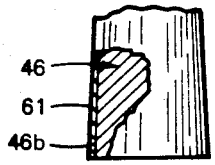
FIG. 3A is a fragmentary view on reduced scale of a modified ice penetrator for the deployment system of FIG. 2.
Figure 5:
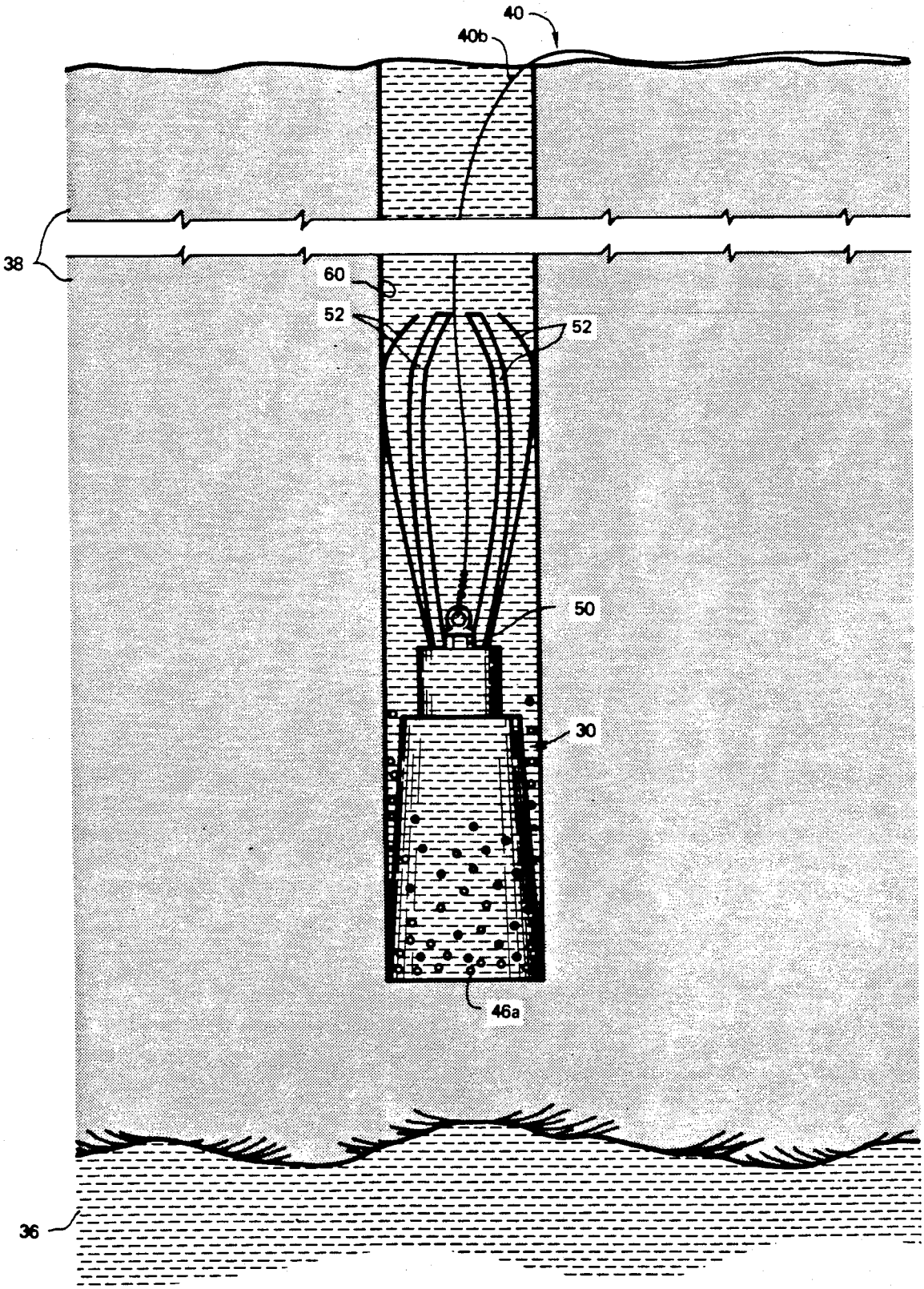
FIG. 5 is an enlarged vertical section through the ice floe in FIG. 2 illustrating one of the ice penetrators in the process of penetrating downwardly through the ice.

The thermochemical reactant of each ice penetrator 46 is gradually consumed, of course, as the penetrator descends through the ice. In this regard, reference is made to the earlier discussion of the lithium-water reaction for an indication of the rate of lithium consumption. This consumption of the penetrator reactant gradually reduces both the axial and radial dimensions of the penetrator 46. According to the present invention, these penetrator dimensions are made sufficient to assure downward passage of each ice penetration device 30 and its hydrophone 34 through the entire thickness of the ice 38. According to a feature of the invention, the side surface 46*b* of each ice penetrator 46 may be coated with a water impervious barrier layer 61 (FIG. 3*a*) of silicon or other material which erodes as the thermochemical reactant is consumed axially but prevents consumption of the reactant in the radial direction which would reduce its diameter.

It is preferable that the ice hole 60 produced by each ice penetrator 30 be as straight and vertical as possible. According to a feature of the invention, the elongate shape of the penetrator body 44 provides guidance means which tends to guide the penetrator along a relatively straight path through the ice. The spring arms or blades 52 at the rear end of the penetrator body provide additional guidance means for this purpose.

To this end, the rear free ends of the spring arms 52, when in their normal unstressed positions of FIG. 3, are radially spaced from the longitudinal axis of the penetrator body 44 a distance substantially greater than the initial radius of the lower leading end of the ice penetrator 46. Accordingly, during entrance of the ice penetration device 30 into the ice 38, their spring arms 52 will contact the walls of their ice holes 60 and will be deflected inwardly to their positions of FIG. 5. In these deflected positions the rear free ends of the arms bear resiliently against the walls of their ice holes 60 to resist the tendency of the penetration device to invert as a result of its inherent instability created by the location of its relatively heavy ballast 48 above its relatively light ice penetrator 46. The arms thus tend to guide the ice penetrators along relatively straight, vertical paths through the ice.

It will be understood at this point, therefore, that after initial placement of the hydrophone deployment system 32 on the surface of the ice 38, the several ice penetration devices 32 will melt their way downwardly through the ice, finally emerging into the water 36 below the ice. The penetrators produce a series of ice holes 60 extending through the ice.

As each penetration device 30 descends through the ice 38, it draws its lower cable section 40*b* from its cable coil 58 into the respective ice hole 60. As noted earlier, the length of this cable section is a few feet greater than the thickness of the ice 38. The penetrator release link 54 is located immediately adjacent to the Hydrophone 34. Accordingly, each ice penetrator 30 will emerge from the underside of the ice 38 into the water 36 below the ice before all of the cable in the cable coil 58 has been drawn into the respective ice hole 60. The ice penetrator then continues to descend through the water and draws the respective penetrator release link 54, hydrophone 34, and finally the upper cable section 40*a* contained in the cable coil 56 into the ice hole 60. The link and hydrophone are dimensioned to freely enter and pass freely through the ice hole.

This deployment action continues until the upper cable section 40*a* becomes taut at which time, the hydrophone 34 occupies its final deployed position shown in broken lines in FIG. 2. Recalling that the length of the upper cable section 40*a* equals the sum of the radial distance from the transmitter 42 to the respective ice hole 60, the ice thickness at the hole, and the desired deployed depth of the hydrophone below the ice, it will be understood that in its final deployed position, the hydrophone is suspended in the water 36 a given distance below the ice 38. At this time, the ice penetration device 30 remains suspended by the lower cable section 40*b* below the hydrophone.

As noted earlier, the ice penetrator release link 54 in each lower cable section 40*b* is designed to release the respective ice penetration device 30 from the corresponding hydrophone 34 after deployment of the latter. Any suitable type of release link may be utilized for this purpose. One such link is a water soluble link including a water soluble element which slowly dissolves at a controlled rate such that the link parts after a predetermined time of exposure to water. The link 54 is designed to part after a period of time sufficient to permit deployment of each hydrophone to the position of FIG. 2. After release, each ice penetration device drops free to the ocean floor.

While the illustrated hydrophone deployment system utilizes the ice penetrator release links 54 to release the ice penetration device 30 after deployment of the hydrophones 34, these links may be eliminated and the penetration devices may remain attached to the hydrophones, if desired. As mentioned earlier, however, it is desirable from the design standpoint to fabricate the ice penetrators and hydrophones as separate components since it eliminates the necessity of imposing penetrator design constraints on the hydrophones and/or imposing hydrophone design constraints on the ice penetrators. In some cases, however, the hydrophones may be embodied in the ice penetrators, as in a later describe embodiment of the invention.

Summarizing the deployment sequence of the hydrophone deployment system 30, the latter is placed manually on the surface of the ice 38. The ice penetration devices 30 immediately commence melting their way downwardly through the ice and eventually emerge from the underside of the ice into the water 36 there below. Continued descension of the devices through the water then draws the penetrator release links 54 and hydrophones 34 into and through the ice holes 60 produced by the penetrators to the final deployed positions of the hydrophones shown in broken lines in FIG. 2. Sometime thereafter, the release links 54 part to release the penetration devices which then drop to the ocean floor.

The deployed hydrophone system may operate in various modes. For example, the system may be designed to transmit signals representing actual underwater sounds detected by the hydrophones. Alternatively, the system may include means for transmitting a prerecorded signal in response to detection of underwater sounds by the hydrophones. In addition, the signal processor transmitter 42 may embody means for converting output signals from the several hydrophones 34 into a transmitted signal representing the direction of the underwater sounds. The detected signal processor/transmitter 42 may be powered by batteries, solar energy, or in any other convenient way. The signals may be transmitted in real time or stored for transmission in response to signals from a remote control station. Finally, although the system 30 has been described in the context of a multiple hydrophone deployment system, other types of underwater transducers may be deployed such as underwater signal transducers, sound generators, sonar sensors or decoys which may be actuated automatically by the signal processor 42 or by signals transmitted to the signal processor from a remote control station. The system may be utilized, of course, to deploy any number of transducers including a single transducer as well as other objects than transducers.

Figure 6:
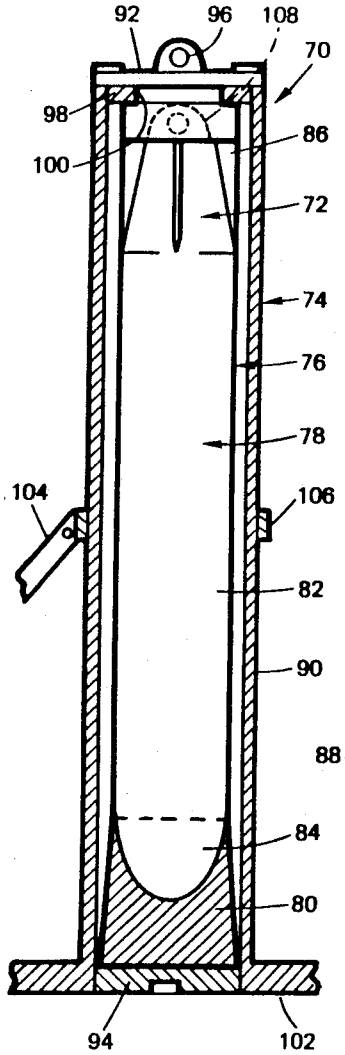
FIG. 6 illustrates a thermochemical ice penetrating weapon deployment system according to the invention.

Reference is now made to FIGS. 6–9 illustrating an ice penetrating weapon system 70 including a thermochemical ice penetrating weapon device 72 according to the invention, which in this case is an explosive mine or torpedo, and a storage container/penetration guide 74 for the weapon device. As shown in FIG. 6, the thermochemical ice penetrating weapon device 72 has an elongated body 76 including a weapon 78 proper and a thermogenic portion or ice penetrator 80 at the front end of the weapon. The weapon 78 has an elongated cylindrical body 82 of uniform diameter for the most of its length with a rounded nose portion 84 and a finned tail portion 86. The ice penetrator tip 80 comprises a thermochemical reactant material, preferably lithium or a lithium alloy, which reacts exothermically with water. This penetrator is round in cross-section and is tapered from a diameter at its front end which is somewhat larger than that of the weapon body 82 to a diameter at its rear end which approximates or is slightly larger than, the weapon body diameter.

Entrance of the ice penetrating weapon device 72 into the ice 88 to be penetrated requires orientation of the device in an upright position and retention of its penetrator 80 in contact with the ice. The ice penetrating weapon system 70 utilizes the guide 74 for positioning the weapon device 70 upright to enter the ice 88 and utilizes the weapon 78 as ballast for maintaining its ice penetrator 80 in contact with the ice. Guide 74 also provides a hermetic enclosure for housing the weapon device 70 during storage and transfer from one location to another.

Guide 74 includes a cylinder 90 sealed at its upper end by a removable upper end plate 92 and at its lower end by a removable lower end plate 94. In the particular embodiment shown, the upper end plate is bolted to the cylinder and the lower end plate is threaded in the cylinder. The cylinder and its end plates form a hermetic enclosure. The upper end plate has a bail 96 by which the guide 74 may be hoisted by a cable during storage and transit. At the upper end of the cylinder 90, just below the upper end plate 92, is an internal annular shoulder 98 whose purpose will be explained presently. This shoulder has a central opening 100 which is sealed by the upper end plate.

Surrounding and rigidly joined to the lower end of the cylinder 90 in a plane normal to the cylinder axes is a circular base 102. Struts 104 extend between this base and an annular rib 106 about the center of the cylinder.

Weapon device 72 is housed within the cylinder 90 for storage and shipment from one location to another. In this regard it will be seen in FIG. 6 that the cylinder is sized to closely receive the weapon device with its tip end adjacent the lower end plate 94. The cylinder and its end plates then form a hermetic enclosure for the weapon device to isolate its ice penetrator 80 from moisture in the air. As noted above, the upper end plate has a bail 96 by which the guide 74 and the contained weapon device 72 may be hoisted by cable during storage and transportation from one location to another. At the rear end of the weapon 78 is a bail 108 which is assessible through the opening 100 in the cylinder shoulder when the upper end plate 92 is removed for attachment of the bail to a hoist cable during deployment of the weapon device, as explained below.

The weapon system 70 may utilize any convenient procedure for transporting it to a weapon deployment site and depositing the weapon system on the ice at the site. The particular weapon system illustrated utilizes a helicopter 110 with a hoist cable 112 for this purpose. This hoist cable is attached to the bail 108 on the weapon 78 by a self-releasing hook or a hook which is otherwise releasable, as discussed below, upon landing of the weapon system on the ice 88. Attachment of the hoist cable to the weapon bail 108 requires removal of the upper guide end plate 92. The lower guide end plate 94 must be removed prior to lowering of the guide and weapon device onto the ice.

In the event that the weapon system 70 is flown to the weapon deployment site within the body of the helicopter 110, it may be possible to attach the hoist cable to the weapon bail 108 and remove the lower guide end plate 94 in flight to or upon arrival at the deployment site. If this is not possible, or if the guide and weapon device are flown to the deployment site while suspended on the hoist cable 112 below the helicopter, removal of the guide end plates and attachment of the hoist cable to the weapon must be accomplished before departure of the helicopter from its base.

Figure 7:
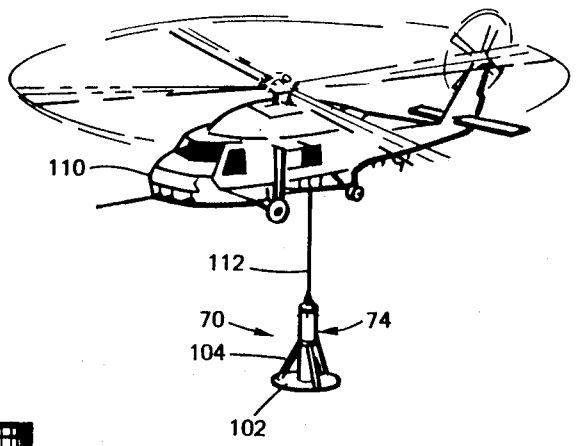
FIG. 7 illustrates helicopter placement of the weapon system of FIG. 6 on the ice to be penetrated.
Figure 9:
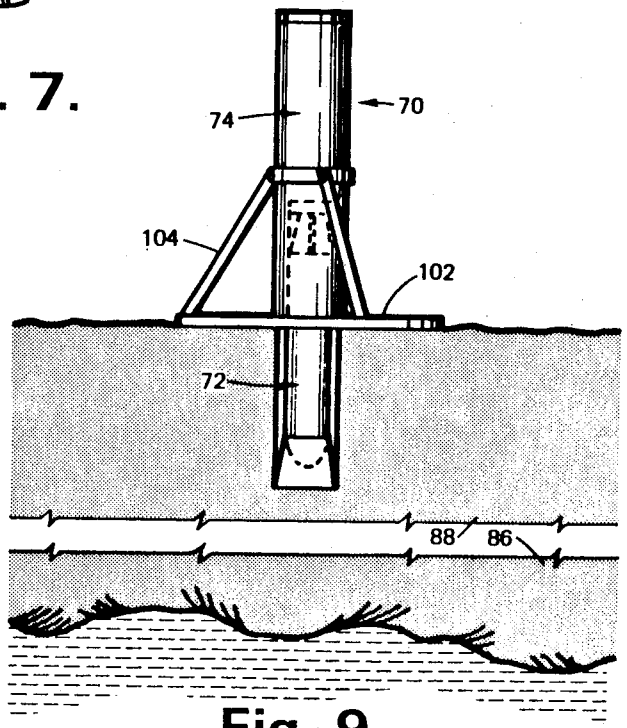
FIG. 9 is a view similar to FIG. 8 illustrating the weapon system after partial penetration of the ice penetrating weapon into the ice.

In either event, the weapon system 70 is lowered by the hoist cable 112 onto the surface of the ice 88 at the desired deployment site, as shown in FIG. 7. In this regard, it will be seen that during this lowering operation, the rear inner shoulder 98 on the guide cylinder 90 rests on the rear end of the weapon device 72 so that the guide is supported on the weapon device which in turn, is suspended by the cable 112. As noted earlier, the hoist cable is attached to the weapon device by a hook which releases automatically or is otherwise releasable upon landing of the guide in its upright position of FIG. 8 on the ice.

Figure 8:
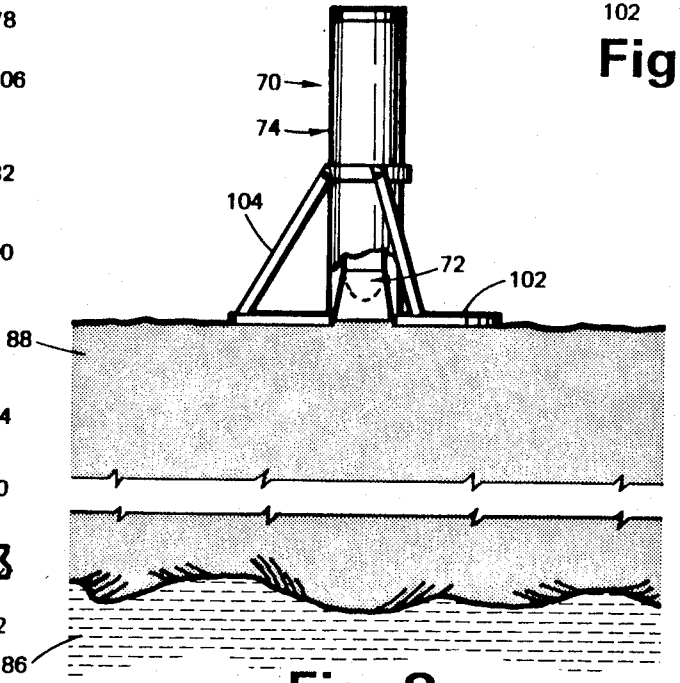
FIG. 8 is a side elevation on reduced scale and partly in section, of the weapon system of FIG. 6 in an initial position on the ice surface.

Disengagement of the hoist cable 112 from the weapon device 72 releases the latter to drop in the guide cylinder 90 to the position of FIG. 8 wherein its thermal ice penetrator 80 rests on the ice 88 and places the full weight of the weapon 78 on the tip. The penetrator then reacts exothermically with water at the interface between the penetrator and the ice and the weapon device melts its way downwardly through the ice in the same way as the earlier described embodiments of the invention. The guide 74 guides the weapon device 72 along a vertical path during its entrance into the ice. The elongated shape of the weapon 78 then cooperates with the wall of the ice hole to continue guidance of the weapon along a generally vertical path through the ice. The weapon eventually emerges through the underside of the ice into the water below the ice, after which it may sink to the bottom, float, propel itself through the water or operate in some other fashion. In this regard, it will be recalled that the weapon 78 may be an explosive mine, torpedo or the like.

The thermochemical ice penetration devices described thus far are initially placed in the proper upright position to penetrate the ice and remain in this position as they enter the ice. Thus, the penetration device 10 of FIG. 1 is manually placed in and held in the upright position. The device 32 of FIGS. 2–5 is manually placed in the upright position and remains in this position by virtue of the flat transverse leading face of its ice penetrator. In FIGS. 6–9, the guide 74 initially locates the ice penetrator/weapon device 72 in its upright position and retains it in this position during its entrance onto the ice.

Figure 10:
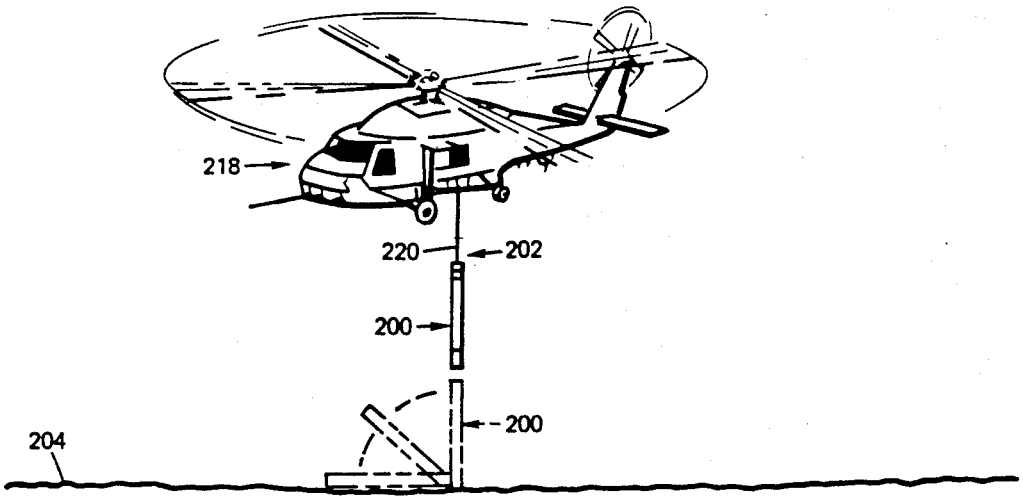
FIG. 10 illustrates a self-reorienting, thermochemical ice-penetrating weapon according to the invention being placed by helicopter on a polar ice floe.
Figure 11:
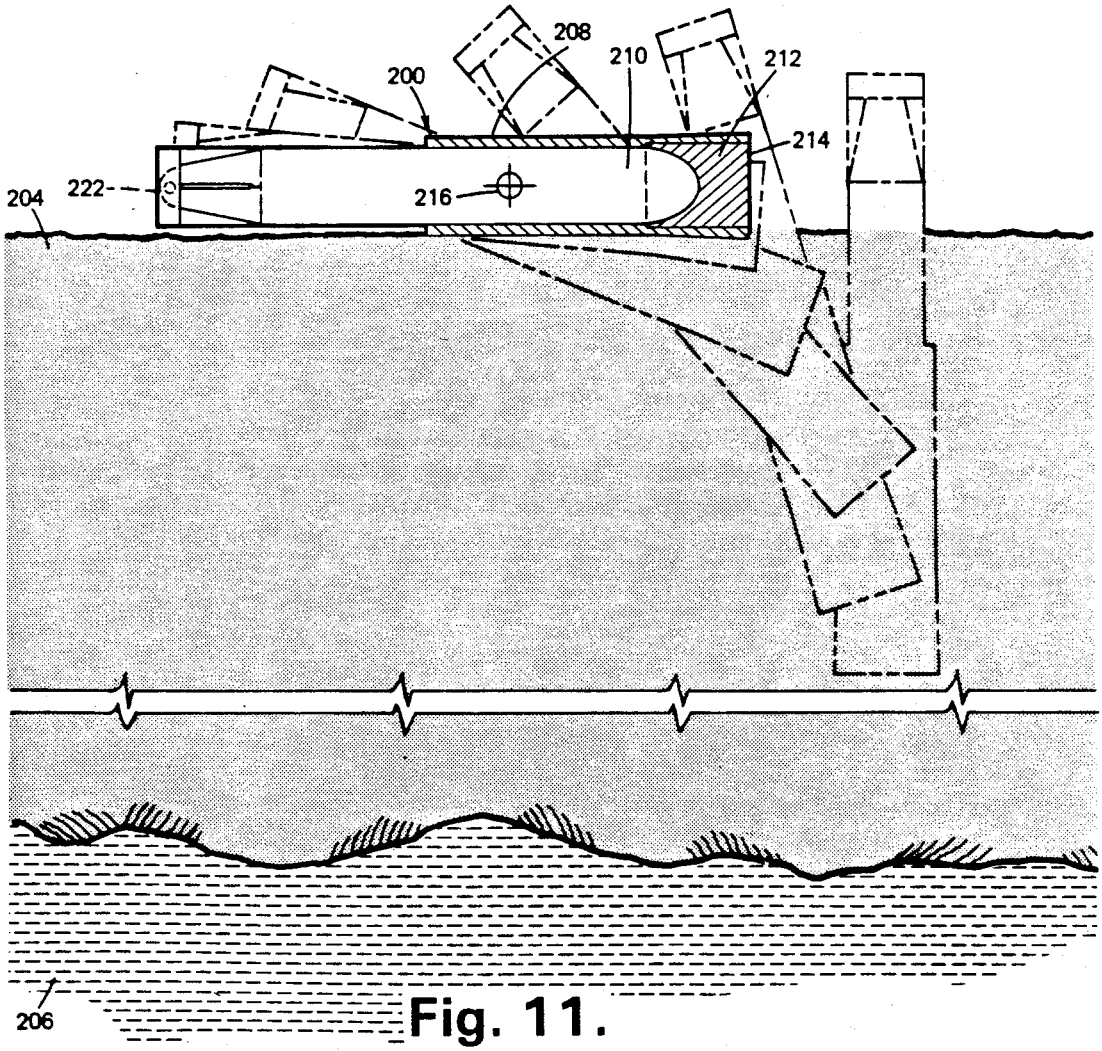
FIG. 11 is an enlarged view illustrating the weapon of FIG. 10 and its self-reorienting action.
Figure 12:
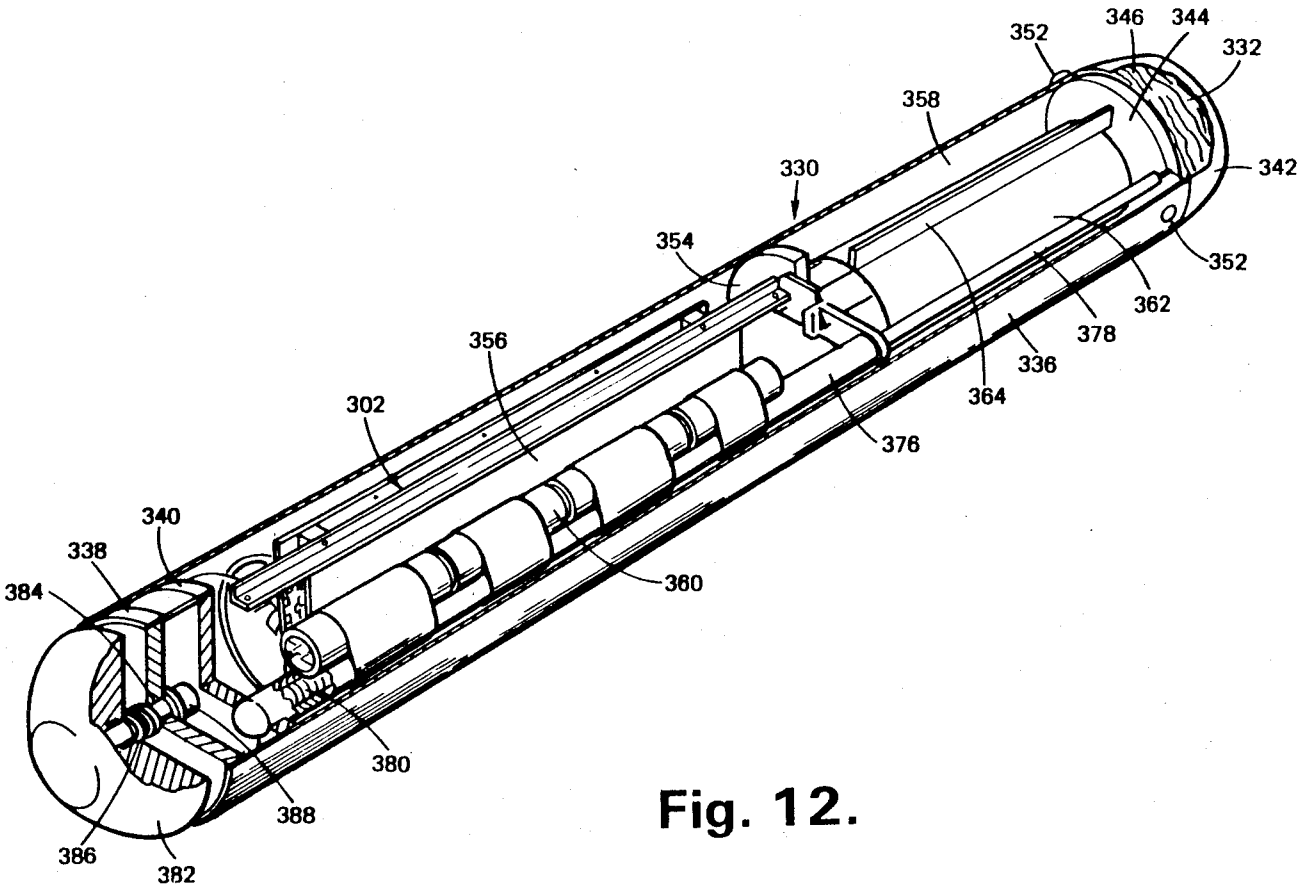
FIG. 12 is a perspective view, broken away, of a parachute equipped, thermochemical ice penetrating acoustic transducer deployment system according to the invention.

Reference is now made to FIGS. 10–12 illustrating a self-righting or self-orienting ice penetrating weapon device 200 according to the invention and means 202 for placing the latter on an ice floe 204 from an aircraft. The ice penetrating weapon device 200 is self orienting in the sense that it automatically reorients itself from an initial horizontal position on the ice surface to an upright position for downward vertical penetration through the ice into the water 206 below the ice.

The ice penetrating weapon device 200 is essentially identical to that of FIGS. 6–9 except for a thermogenic shell 208 about the device. This shell may comprise any suitable thermochemical material such as lithium or a lithium alloy, including an alloy containing a more active thermochemical material than lithium, such as sodium. In addition to the shell 208, the weapon device 200 includes an elongated weapon 210 proper and a thermogenic tip or thermal ice penetrator 212 both surrounded by the shell 208. The weapon 210 may be an explosive mine, torpedo or the like. The heat generating shell 208 extends from the leading end face 214 of the ice penetrator 212 rearwardly along the weapon 210 to a position some distance rearwardly of the center of gravity 216 of the weapon device 200.

As in the case of the weapon system of FIGS. 6–9, the weapon device 200 may be placed on the ice 204 in various ways. The drawings illustrate a helicopter 218 having a hoist cable 220 for lowering the weapon device onto the ice, as shown in full and broken lines in FIG. 10. This cable is attached to a bail 222 at the rear end of the weapon 210 by a hook which releases automatically or in some other way when the weapon device has been deposited on the ice. The weapon device 200, when in its initial position on the ice, lies generally flat on the surface of the ice, as shown in solid lines in FIG. 11.

In this initial position of the weapon device 200, its heat generating shell 208 contacts the ice 204 to produce an exothermic reaction between the thermochemical material of the shell and water at the interface between the shell and the ice. Because of the extension of the shell along a forward portion only of the weapon device and location of its center of gravity 216 between the ends of the shell, the heat of the reaction between the shell and the ice melts the ice under the forward portion only of the device which thus commences to tilt downwardly, as depicted in broken lines in FIG. 11. As this tilting action continues, a gradually increasing forward axial gravitational force component is produced on the weapon device which urges the leading end face 214 of its ice penetrator 212 against the ice, thereby initiating melting of the ice in front of the device also. This combined action of melting of the ice by the shell 208 and the ice penetrator 210 causes the weapon device 200 to gradually descend into the ice through the several broken line positions of FIG. 11 and thereby progressively reorient itself from its initial generally horizontal position on the ice surface to a final generally vertical position within the ice. The elongate shape of the weapon 210 then guides the weapon device along a generally vertical path downwardly through the ice. As in FIGS. 6–9, the weapon device eventually emerges from the underside of the ice 204 into the underlying water 206.

The thermogenic shell 208 may be sized in thickness so that it is not totally consumed until shortly after the weapon device reaches its vertical or upright position. Alternatively, the shell may be sized to remain through the entire passage of the weapon device through the ice.

Figure 13:
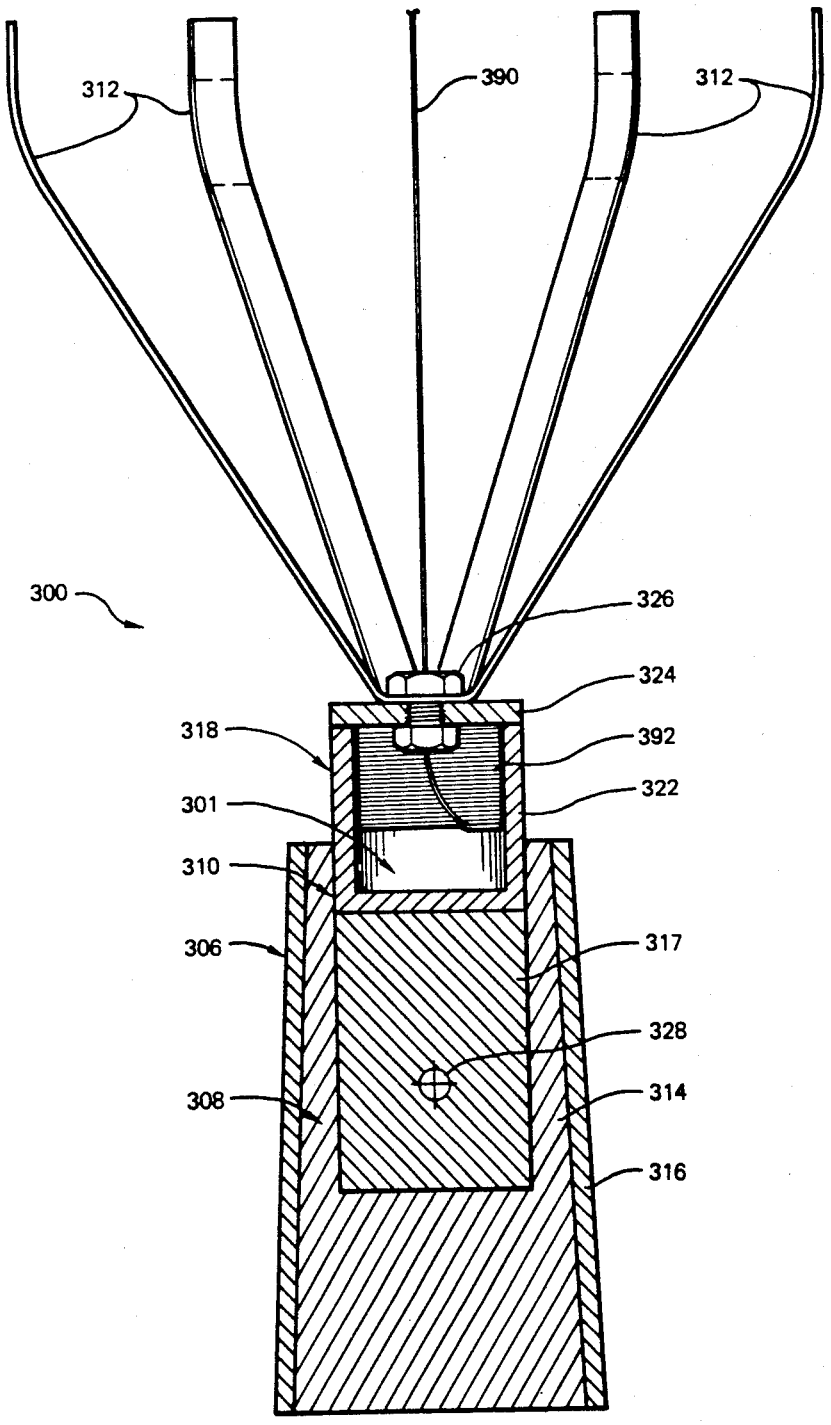
FIG. 13 is an enlarged section through a self-reorienting thermochemical ice penetrator and acoustic transducer embodied in the system of FIG. 12.

The ice penetrating instrument deployment device of FIGS. 12–17 includes a modified self-orienting thermochemical ice penetration device 300 according to the invention, an acoustic transducer 301, a signal processor 302, and means 303 for landing the deployment device on an ice floe 304. The ice penetrating device 300, shown in enlarged detail in FIG. 13, is essentially identical to that of FIGS. 2–5 except in two respects, discussed below. Thus, the device 300 has an elongate body 306 including a forward ice penetrator 308, a rear ballast 310, and spring blades or arms 312 secured to the rear end of and extending rearwardly from the penetrator body. The penetrator 308 is comprised of a material, preferably lithium or a lithium alloy, which reacts exothermally with water and tapers with an increasing diameter toward its normally lower leading end.

As thus far described the ice penetrating device 300 is essentially identical to that of FIGS. 2–5. The device 300 differs from that of FIGS. 2–5 in the following two respects. First, its ice penetrator 308 has a central core 314 and a shell 316 about the core. Both the core and shell are tapered and composed of a thermochemical material. Secondly, the penetrator ballast 310 includes a ballast weight 317 and a housing 318 containing the transducer 301. The housing also contains a wire coil as explained later.

The housing 318 has a rearwardly opening cup-like body 322 and a rear closure 324 rigidly joined to the body. The spring arms or blades 312 are secured to the closure 324 by a bolt and nut assembly 326. As in the ice penetrating device of FIGS. 2–5, the rear ends of the spring arms 312, in their normal unstressed positions of FIG. 13, are radially spaced from the axis of the penetrator body 306 a distance substantially exceeding the radius of the leading end of the ice penetrator 308. The arms are deflectable inwardly to the leading end radius of the penetrator tip. The center of gravity 328 of the ice penetrating device 300 is located between the ends of the penetrator shell 316, as shown.

The instrument deployment device of FIGS. 12–17 may be deployed onto the ice 304 in various ways. In the particular embodiment shown, the device is parachuted onto the ice and to this end includes a canister 330, shown in FIGS. 12 and 16. This canister contains a folded parachute 332 which is released from the canister when the latter is dropped from an airplane (not shown). Impact of the canister with the ice effects expulsion of the ice penetrating device 300 and its contained transducer 301 from the canister, after which they penetrate downwardly through the ice to deploy the transducer into the water 334 below the ice.

In this embodiment, as in that of FIGS. 2–5, the transducer 301 may be an acoustic decoy, signal transmitter, sound generator, sonar sensor, or the like, but is assumed to be a hydrophone. The signal processor 302 is a transmitter for transmitting to a remote monitoring station in response to underwater sound detection by the hydrophone, signals representing the detected sound or prerecorded signals or any other appropriate signals.

Figure 14:
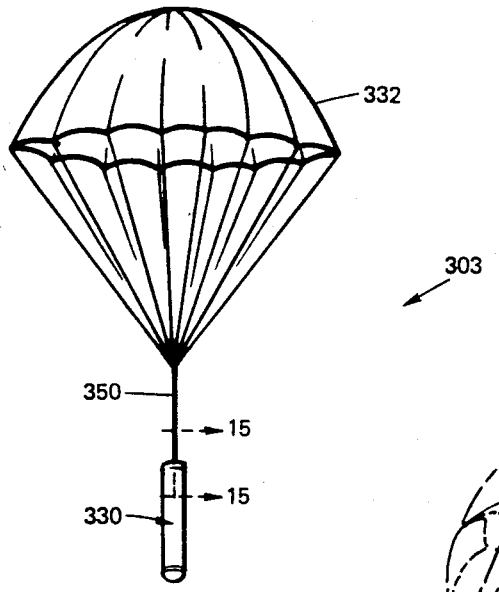
FIG. 14 illustrates, on reduced scale, a parachute drop of the system of FIG. 12.
Figure 16:
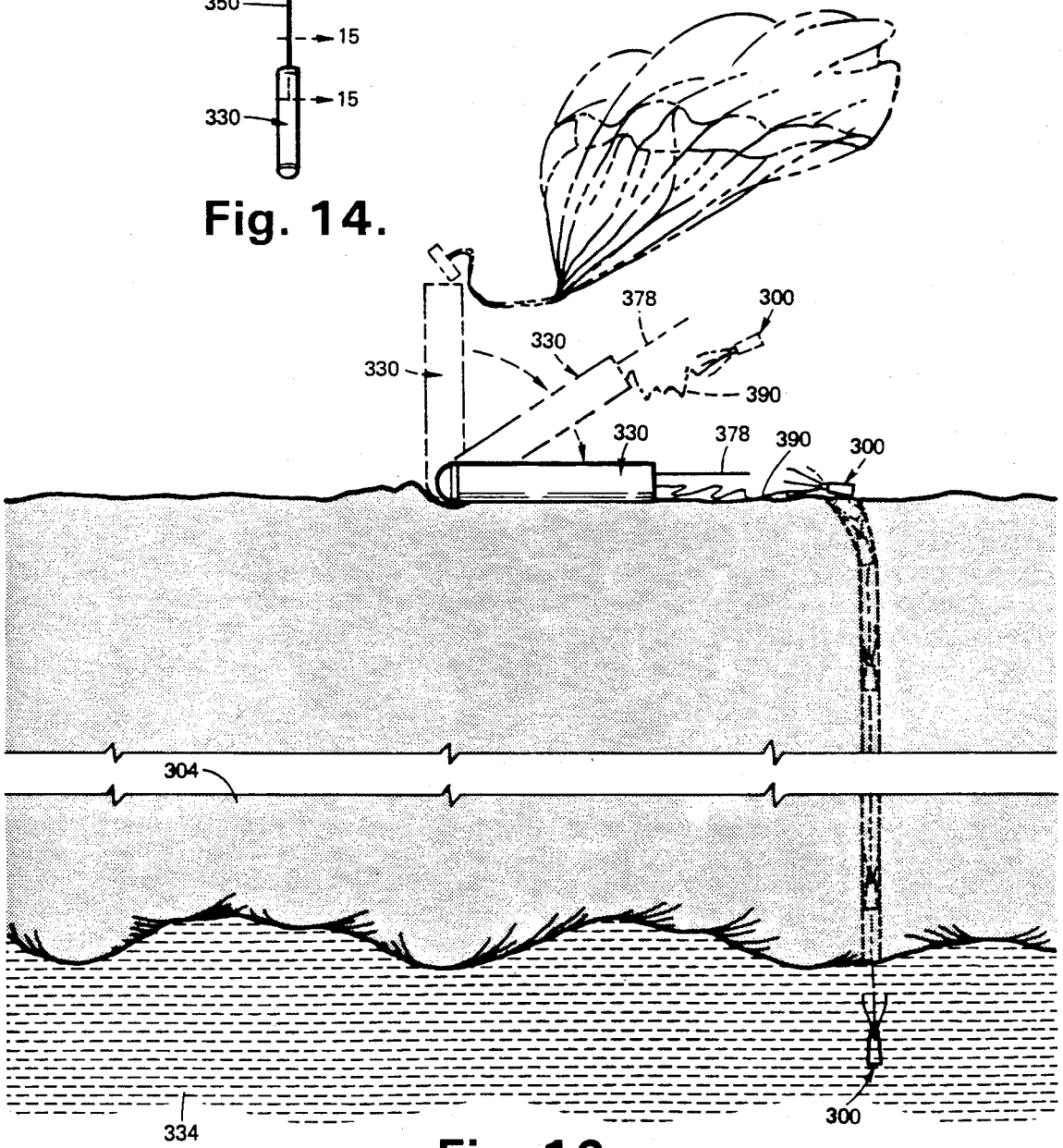
FIG. 16 illustrates the transducer deployment sequence of the system of FIG. 12.

Referring to FIGS. 12 and 13, the canister 330 comprises a cylinder 336 having a rear end closed by spaced end walls 338, 340 which are permanently joined to the cylinder. The other or front end of the cylinder is closed by a cover 342 and an end plate 344 which are separable 14–15) secured to the end plate 344. The end plate 344 define there between a space 346 for receiving folded parachute 332. This parachute has a line 350 (FIGS. 13–15) secured to the end plate 344. The end plate 344 is sealed to the cylinder 336 and is releasably secured to the cylinder by explosive fasteners 352 which may be detonated to release the plate for separation from the cylinder. The cover 342 is releasably joined to the cylinder 336, and the parachute 332 and cover are arranged in any conventional manner such that the canister 330 with its contents may be air-dropped by the parachute from an airplane onto the ice floe 304, as illustrated in FIGS. 14 and 16. The cover 342 is separated from the canister 330 in any convenient way to release the parachute 332 during this airdrop. The end plate 344 to which the parachute is attached remains firmly secured to the canister by the fasteners 352, whereby the parachute supports the canister in an upright position with its rear end lowermost during the airdrop.

Rigidly mounted within the canister 330 between its ends is a transverse bulkhead 354. Between this bulkhead and the canister ends is a rear compartment 356 and a front compartment 358. The rear compartment contains the signal processor 302 and a battery pack 360. The front compartment contains a tube 362 slidably receiving the ice penetrating device 300. Tube 362 is concentric with and smaller in diameter than the canister. The tube is rigidly secured at its rear end to the bulkhead 354 and by radial ribs 364 to the canister. Fixed within the front end of the tube 362 is a sleeve 366.

The ice penetrating device 300 is positioned within the tube 362 with its ice penetrator tip 308 disposed within the tube sleeve 366 and its spring arms 312 bearing resiliently against the inner wall of the tube rearwardly of the sleeve. The sleeve is internally tapered at the same angle as the penetrator tip and is internally sized to receive the tip with its tapered surface in contact with the internal sleeve surface. The front or leading end of the tip is spaced from the canister front end plate 344.

Coaxially positioned between the rear end of the ice penetrating device 300 and the canister bulkhead 354 is a spring actuator 368 having a cylinder 369 rigidly attached to the bulkhead. The cylinder contains a piston 370 and a compression spring 372 for urging the piston forwardly against the rear end of the penetrator transducer housing 318. Coaxially fixed to the rear side of the end plate 344 is a compression spring 374 which seats against the leading face of the penetrator 308. As will be explained presently, the spring 374 expels the end plate 344, and the spring actuator 368 expels the ice penetrating device 300 from the canister 330 in response to landing of the canister on the ice 304.

Figure 15:
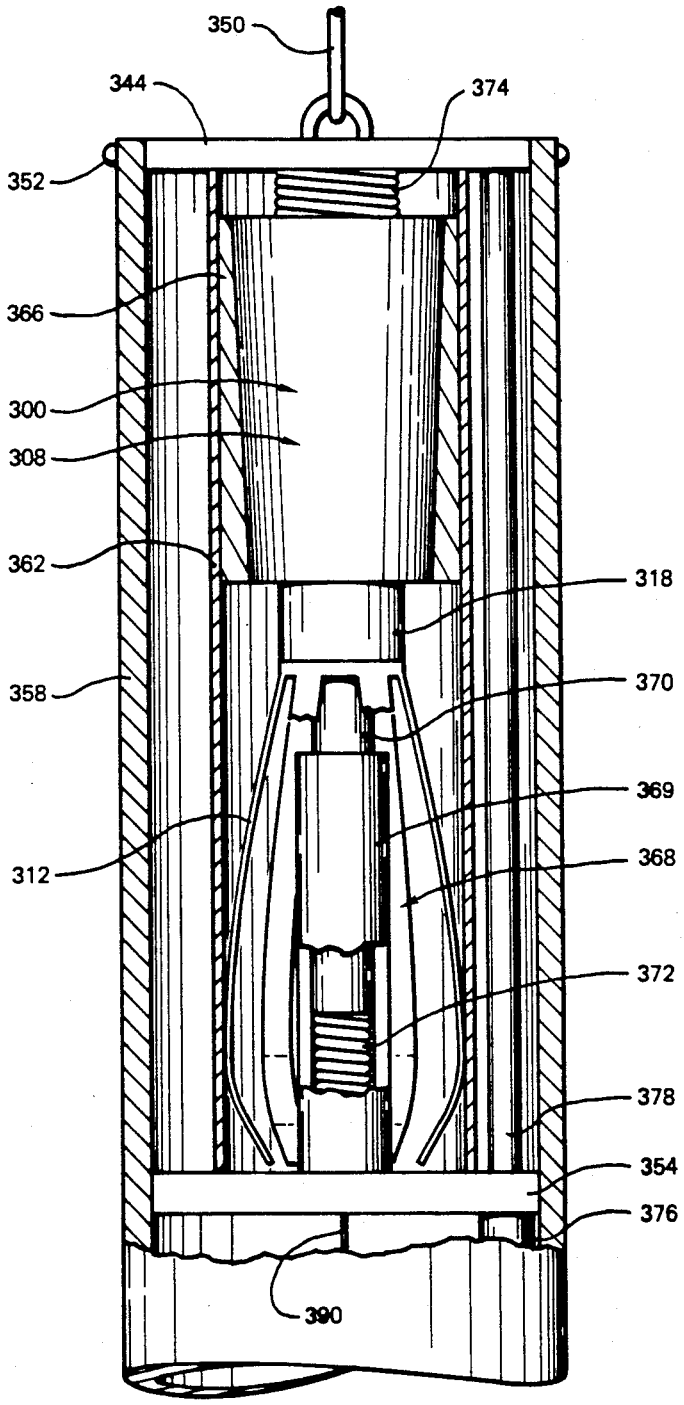
FIG. 15 is an enlarged section taken on line 15—15 in FIG. 14.
Figure 17:
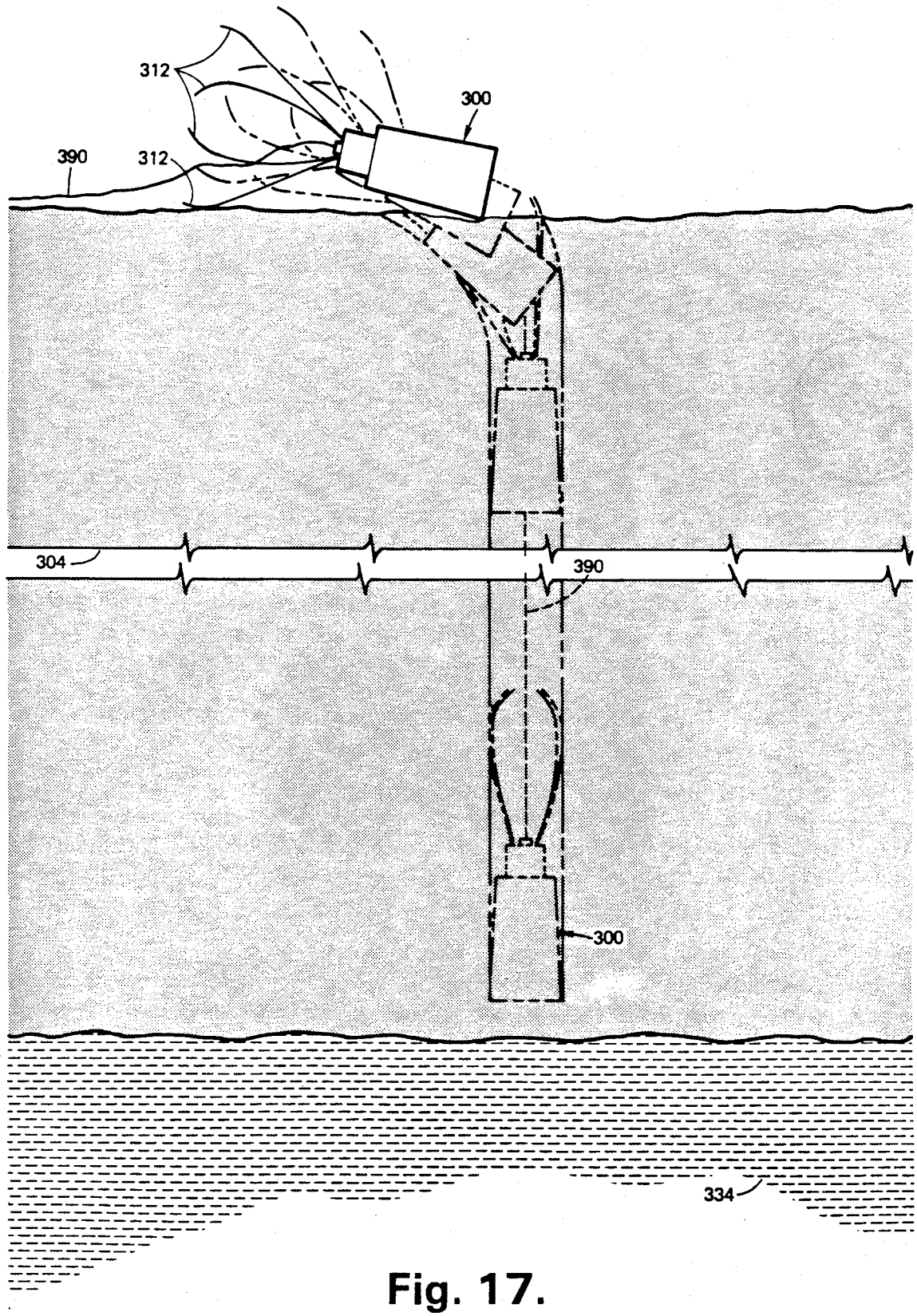
FIG. 17 illustrates on enlarged scale the selfreorienting action of the ice penetrator/transducer of FIG. 14.

Extending longitudinally through the rear canister compartment 356 between and fixed at its ends to the canister bulkhead 354 and rear end wall 340 is a long, slender cylinder 376 axially aligned with the space between two adjacent supporting ribs 364 for the ice penetrator support tube 362. Slidably fixed within the cylinder 376 is an antenna 378 which extends longitudinally through the forward canister compartment 358 and is electrically coupled to the signal processor 302. A compression spring 380 within the cylinder 376 urges the antenna 378 forwardly into contact with the front end plate 344 when the latter is positioned in the canister and to its extended operating position of FIG. 16 when the end plate is expelled from the canister after landing on the ice. Cylinder 376 supports the battery pack 360, as shown in FIG. 15.

At the rear end of the canister 330 is a pad 382 to which is rigidly fixed a coaxial shaft 384. Shaft 384 extends slidably through the rear canister end wall 338 into the space between this wall and the end wall 340. Surrounding the shaft 384 is a compression spring 386 which urges the pad 382 rearwardly away from the end walls 338, 340. Disposed between the end walls is a switch 388 which is actuated by the shaft 384 upon forward displacement of the pad 382 toward the end walls. Switch 388 is connected in circuit with the battery pack 360 and explosive fasteners 352 to detonate the fasteners and thereby release the front end plate 344 for separation from the canister 330 upon actuation of the switch by forward displacement of the pad 382.

The ice penetrating device 300 and canister 330 are electrically and mechanically connected by a combined electrical and loadbearing cable 390. The major length of this cable is coiled within transducer housing 318 of the device, as shown at 392 in FIG. 13. One end of the cable is firmly mechanically attached to the ice penetrator body 310 and electrically connected to the transducer 301. The other end of the cable extends from the transducer housing through a passage in the bolt 326 which secures the spring arms 312 to the penetrator body. This passage is sized to relatively loosely receive the cable 390 in such a way that the cable can pull freely from the cable coil 392 during downward passage of the penetrating device 300 through the ice 304, as explained below. The other end of the cable extends axially through the penetrator expulsion actuator 368 in such a way as to not interfere with spring extension of the actuator and is firmly mechanically attached to the canister 330 and electrically connected to the signal processor 302.

It will now be understood that the cable 390 forms a load bearing element connecting the ice penetrating device 300 and canister 330 and provides an electrical connection between the transducer 301 and signal processor 302. Relative to its load-bearing function, the cable is sized to support the device below the ice 304 in the manner explained later. In the particular embodiment illustrated, in which the transducer is a hydrophone and the signal processor is a transmitter, the cable 390 conducts electrical signals from the transducer to the transmitter and the latter transmits signals through the antenna 378 to a remote monitoring station.

The canister 330 provides a hermetic container for storing and transporting the ice penetrating device 300 and the other components of the transducer deployment system. For deployment, the canister is flown to the desired sonobuoy deployment site, the canister cover 342 is removed, a parachute release line on the airplane is attached to the parachute 332, and the canister is launched from the airplane to parachute the canister onto the ice 304, as shown in FIG. 16.

The canister 330 lands generally upright, pad end first, on the ice 304 in the manner illustrated in phantom lines in FIG. 16. The canister pad 382 is thereby depressed to actuate the switch 388 and detonate the explosive fasteners 352. This releases the canister front end plate 344 for ejection of the latter and parachute 332 from the canister by its spring 374 followed by ejection of the ice penetrating device 300 by the spring actuator 372 as the canister falls from its upright landing position onto its side on the ice surface in the manner shown in FIG. 16. During this ejection of the device, the cable 390 pulls out from the cable coil 392 within the transducer housing 318. The antenna 378 is simultaneously extended to its operating position of FIG. 16 by its spring 380.

The ice penetrating device 300 lands on its side on the ice 304 a short distance from the canister 330. The device then rests on the ice with the side of the shell 316 about the ice penetrator 308 and at least one, and in most cases two, of its spring arms 312 in contact with the ice, as shown in solid lines in FIGS. 16 and 17. These spring arms elevate the rear end of the penetrator body 306 which is thereby initially supported on the ice in the solid line inclined position of the latter figures. Because of this inclined position of the penetrator body, the exothermal reaction between the penetrator 308 and the ice will occur initially adjacent the leading end of the penetrator where it contacts the ice. Accordingly the leading end of the ice penetrator will commence melting laterally downward into the ice while the spring arms remain in contact with the ice surface. As time progresses, therefore, the downward tilt of the ice penetrating device increases as a result of this lateral penetration of its penetrator 308 into the ice.

As in FIG. 11, this downward tilting action produces a gradually increasing forward gravitational force component on the ice penetrating device 300 which urges the leading face of its tip 308 against the ice, thereby initiating melting of the ice in front of the penetrator also. This combined melting of the ice in both the lateral and forward directions of the device causes the latter to descend into the ice through the several positions shown in FIGS. 16 and 17 and thereby gradually reorient itself from its initial, inclined position on the ice surface to a generally upright or vertical position within the ice. The spring arms 312 of the device then bear resiliently against the wall of the ice hole produced by the penetrator to guide the latter along a generally vertical path through the ice.

As the ice penetrating device 300 thus descends through the ice 304, the cable 390 pulls out from the transducer housing 318. In this regard, it will be recalled that in the hydrophone deployment system of FIGS. 2–5, the cable supply, i.e. cable coils 56, 58, is positioned on the ice surface and the cable is pulled from this supply, downwardly through the ice hole as the ice penetrator descends through the ice. This arrangement presents the risk of freezing of the cable in the ice hole above the penetrator, thereby halting downward travel of the ice penetrator, which risk must be eliminated in some way, as explained in the earlier description. Containment of the cable supply in the ice penetrating device, as in FIGS. 13–17 eliminates this risk of cable freezing.

Eventually, the ice penetrating device 300 will emerge through the underside of the ice 304 into the water 334 below the ice. The device then descends freely through the water to a depth determined by the remaining length of cable in the transducer housing 318 of the penetrator. At this point, the ice penetrator and its contained hydrophone 301 remain suspended in the water with the hydrophone electrically connected through the cable 390 to the signal processor 302 in the canister 330 on the ice surface. The canister thus forms a base on the ice surface for anchoring the suspended device. The hydrophone system may operate in various modes, as explained earlier in connection with FIGS. 2–5.

The thermogenic shell 316 on the ice penetrator 308 may comprise the same material as the penetrator core 314, with a water impervious barrier layer between the shell and core. Alternatively, the shell may comprise a more thermochemically active material with or without such a barrier layer, as explained earlier in connection with FIGS. 6–11.

In some cases, the ice and ice penetrator temperatures may be so low that the initial reaction rate may not be sufficiently high to elevate the penetrator temperature to the operational level required for continued ice penetration. This cold start-up problem may be solved in various ways. For example, the ice penetrator may have a cold start-up layer which is sufficiently thermochemically active to initiate melting of the ice at the required rate. This start-up layer may comprise sodium or potassium or an alloy of either or both with lithium or some other material. The thermochemical shells on the ice penetrators in FIGS. 6–18 may be for cold start-up as well as lateral penetration into the ice.

Figure 18:
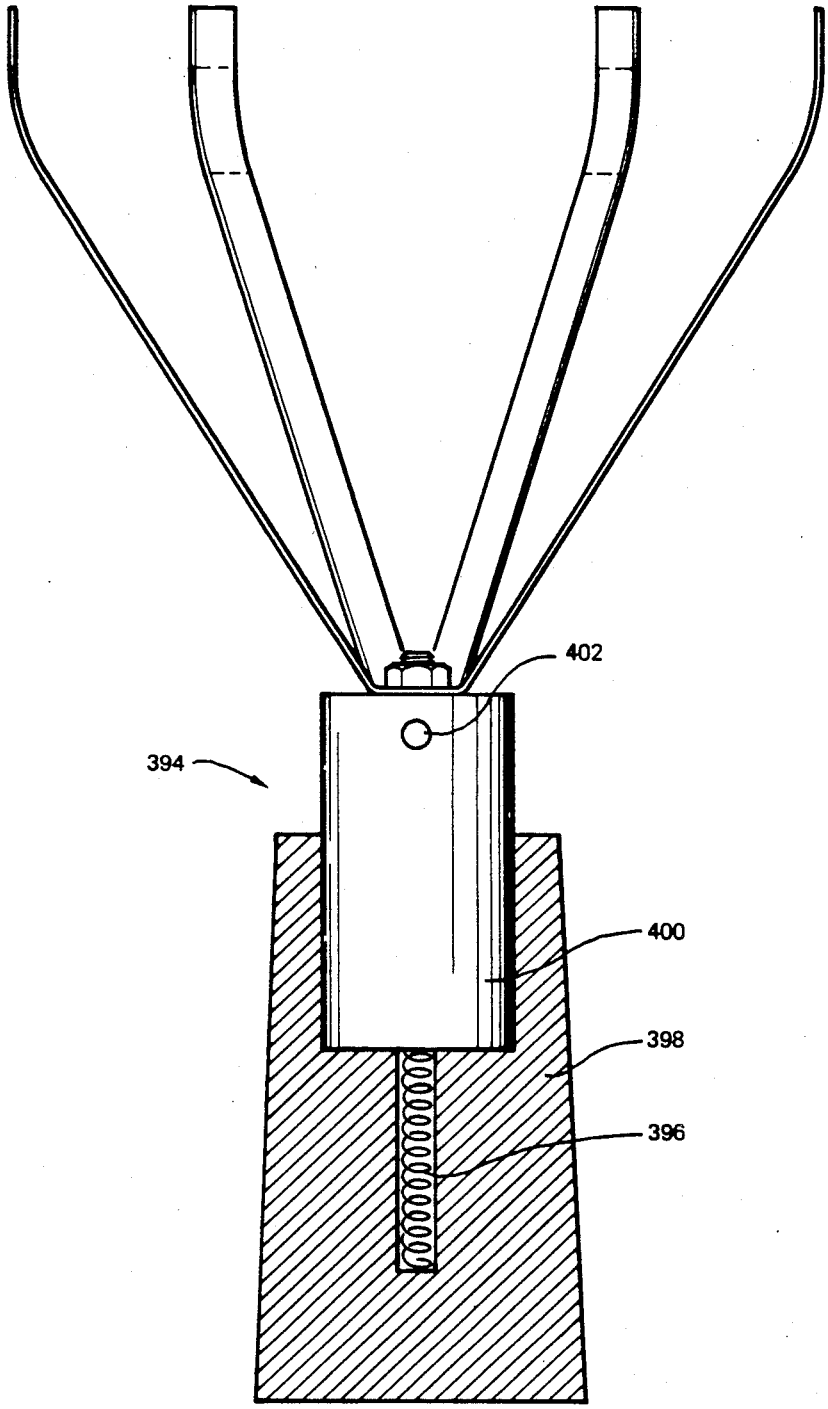
FIG. 18 is a longitudinal section through a thermochemical ice penetrator according to the invention embodying heating means for heating the penetrator thermochemical tip to an operational temperature level under extremely cold conditions.

Other possible solutions to the cold start-up problem are injection of hot water into the interface between the ice and ice penetrator and heating the ice penetrator. FIG. 18, for example, illustrates a modified ice penetrating device 394 like that in FIG. 3 except that it contains an electrical heating element 396 within its ice penetrator 398, a battery 400, and a circuit activated by a switch 402 for energizing the heating element. An air-dropped ice penetrator may be heated prior to being dropped from the aircraft.

The thermal ice penetrators and ice penetration devices described thus far are designed for downward penetration through polar ice for the purpose of deploying an object into the water below the ice. Gravity is utilized as the penetration force for driving the penetrator through the ice as the latter melts ahead of the penetrator. Additional embodiments of the invention will now be described which are launched or released from a submarine submerged below polar ice for the purpose of deploying an object, such as an antenna, instrument, or weapon, upwardly through ice. These upward ice penetrators utilize water buoyancy as the penetration force and may be designed to penetrate either part way through the ice or all the way through the ice to its surface.

Referring first to FIGS. 19–24, there is illustrated an upward ice penetrating submarine antenna deployment unit 600 for deploying from a submarine 602 submerged in the water 603 below polar sea ice 604, a communication antenna which penetrates upwardly through the ice to permit communication between the submarine and a remote communication station. This antenna deployment unit comprises an upward ice penetrating antenna device 606 including flotation means 608, thermal ice penetration means 610 carried by the flotation means for melting a hole upwardly through the ice utilizing the positive buoyancy of the flotation means to provide an upward penetration force, and an antenna means 612 which is deployed upwardly through the ice with the ice penetration means. The illustrated antenna device has an elongated body composed of the flotation means 608 and the ice penetration means 610. The flotation means comprises a sealed relatively rigid hollow tube of sufficient water displacement column to provide the positive buoyancy necessary for ice penetration in the manner to be explained presently.

Figure 20:
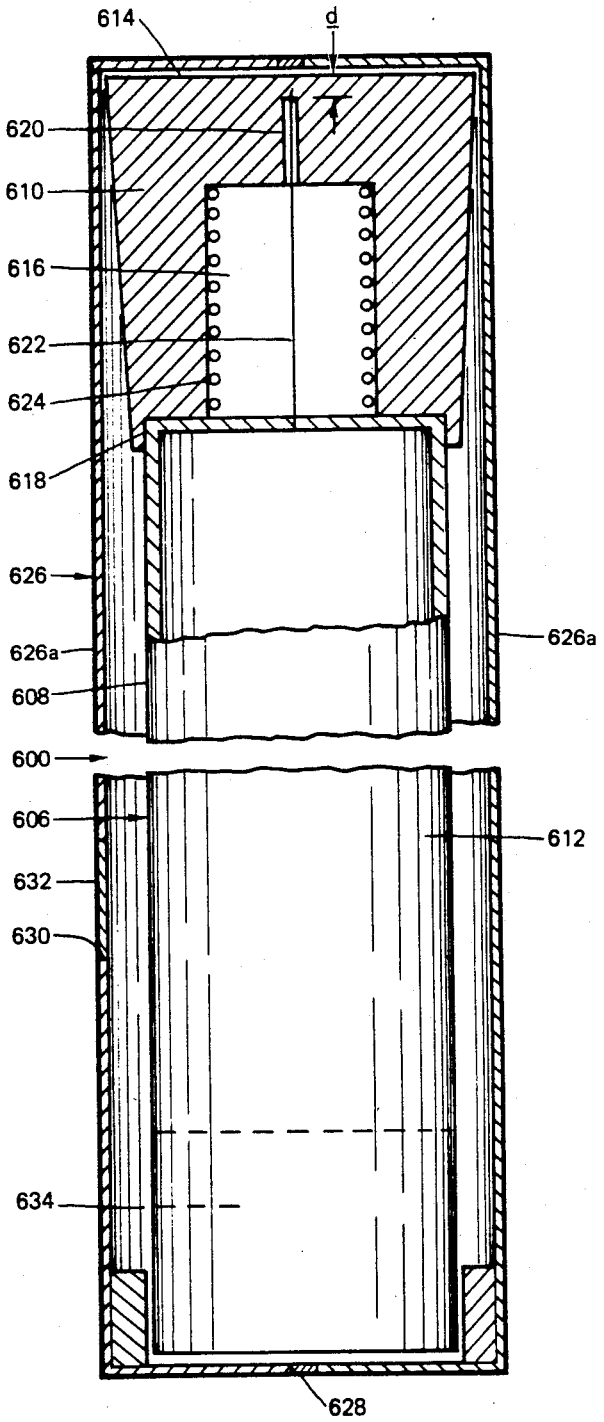
FIG. 20 is an enlarged longitudinal section through the thermochemical ice penetrating antenna deployment unit of FIG. 19 in its predeployment stowage configuration.

Referring particularly to FIG. 20, the thermal ice penetrating means 610 of the antenna device 606 comprises a thermogenic end portion or ice penetrator releasably mounted on the normally upper end of the float tube 608. This ice penetrator is composed of a thermochemical, preferably lithium or a lithium alloy, that reacts exothermally with water. The ice penetrator has a front end reaction surface 614 facing endwise of the penetrator float 608. Entering the rear of the penetrator 610 is a coaxial cavity 616, the rear end of which is enlarged to form a shallow recess 618 for seating the end of the float tube 608. Cavity 616 continues at its front end in a small diameter socket-like bore 620 which terminates at its front end a small distance d from the front end of the ice penetrator. Extending centrally through the cavity 616 and bore 620 is a slender tension member 622, such as a wire, cord or the like, whose rear end is fixed to the front end of the float tube 608 and whose front end is fixed to the ice penetrator 610 at the front end of the bore 620 for securing the penetrator to the tube. Within the cavity 616 is a compressed spring 624 which acts between the tube and penetrator and tends to separate the latter from the tube.

Prior to deployment of the antenna device 606, the ice penetrator 610 remains firmly attached to the float tube 608 by the tension member 622 which prevents separation of the penetrator from the tube by the compressed spring 624. During upward penetration of the antenna device 606 through the ice 604 as explained below, the material of the ice penetrator is gradually consumed rearwardly from its front reaction surface 614 by its thermochemical reaction with water at the reaction surface. The thickness d of the penetrator between its front reaction surface and the front end of the bore 620 is selected so that this thickness will be consumed after the antenna device has penetrated at least a small distance through the ice. Consumption, by the thermochemical reaction, of the thickness d of the ice penetrator 610 releases the latter for ejection from the float tube 608 by the spring 624. Until the ice is completely penetrated, however, the ice penetrator remains caged between the ice and the float tube 608, and thereby effectively remains an integral part of the device, because of the upward buoyant force on the tube. It is significant to note here that in some applications, the ice penetrator may be permanently secured to the float tube, as explained later.

The float tube 608 forms the major structural component of the antenna 612. This antenna may comprise the tube itself if the tube is metallic. Alternatively, the antenna may comprise an electrically conductive antenna element, such as a metal coating or wire on or extending through a plastic tube.

The ice penetrating antenna device 606 may be stowed in and launched or released from the submarine 602 in any convenient way. The particular antenna deployment unit 600 illustrated includes a hermetically sealed stowage container 626 for storing the antenna device 606 prior to launch. This container is designed to withstand the maximum sea pressure to which it will be exposed and is constructed in two semi-cylindrical halves **626*a* hermetically joined by a water soluable seal 628. The container has an opening 630 closed by a water soluable plug 632**.

As will appear from the ensuing description, submarine-decoyed ice penetration devices according to the invention may be designed to be launched through a flare tube or a torpedo tube of the submarine. The antenna deployment device 600 is designed to be launched through a torpedo tube for the reasons explained below. To this end, the stowage container 626 is sized to be launched through a torpedo tube either with or without the aid of a sabot. Launching of the antenna deployment device 600 exposes the water soluable seal 628 and plug 632 to and dissolution by sea water. Dissolution of the seal 628 releases the container halves **626*a* for separation. Dissolution of the plug 632 results in flooding of the stowage container to balance the internal and external pressure on the container and thereby permit its halves 626*a* to separate and release the antenna device 606**.

Figure 19:
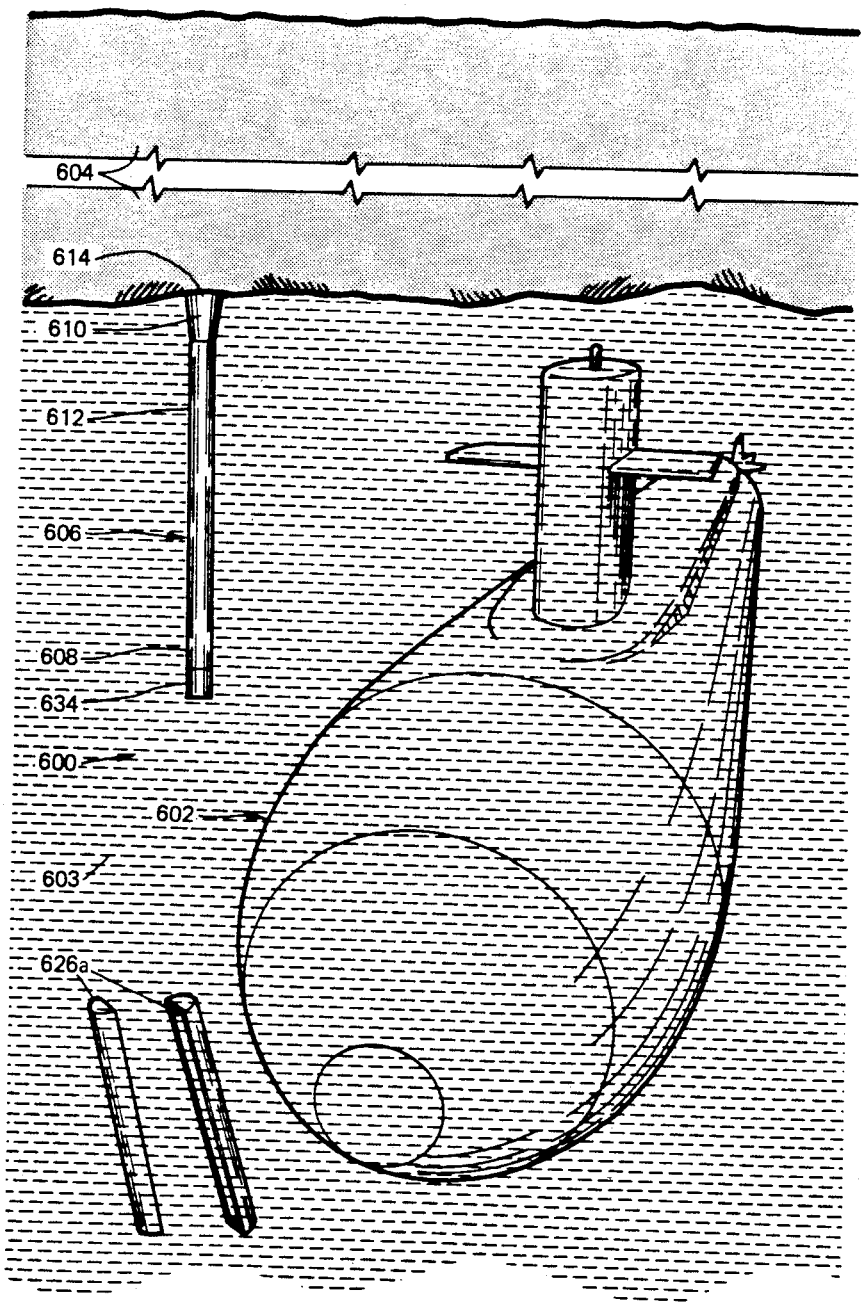
FIG. 19 illustrates a thermochemical ice penetrating antenna deployment system according to the invention for deploying an antenna device upwardly through a polar ice floe to the ice surface from a submarine submerged below the ice.
Figure 23:
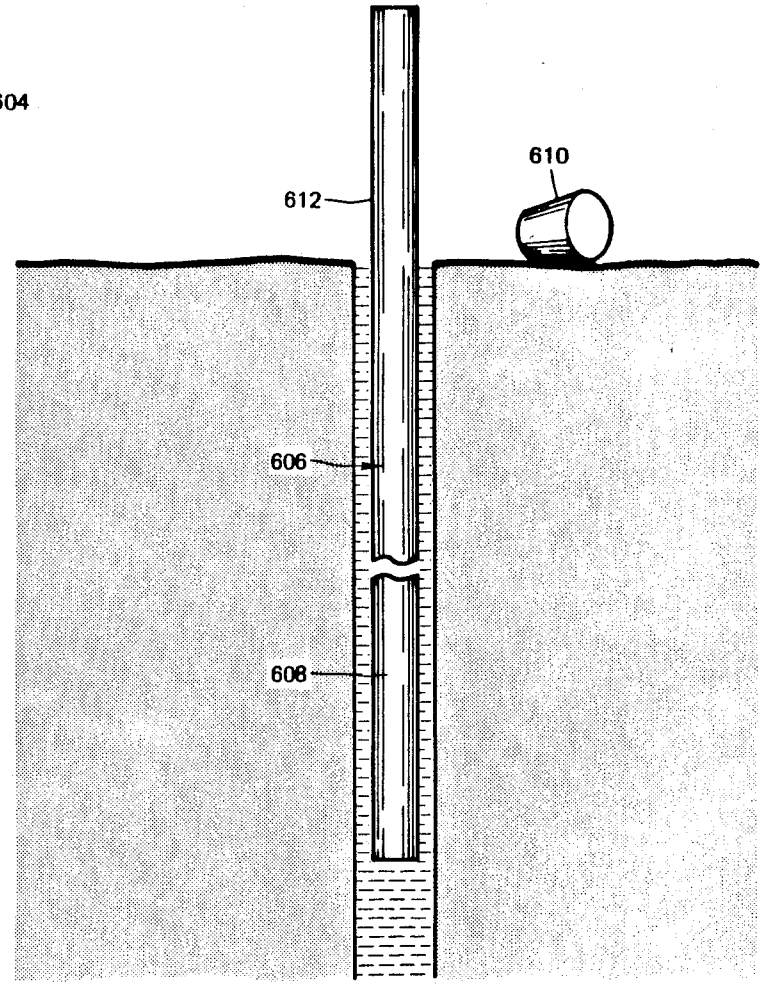
FIG. 23 illustrates the antenna device in its final deployed position.

The antenna device 606 is ballasted so that its center of buoyancy is located between its center of mass and the ice penetrator 610. Accordingly, the device floats upright in the water with the ice penetrator uppermost, and rises through the water until the ice penetrator contacts the underside of the ice 604, as shown in FIG. 19. At this point, the reaction surface 614 of the ice penetrator is urged upwardly against the ice by the buoyant force on the tube 608. This force and the heating which occurs at the reaction surface by virtue of the exothermal reaction between the penetrator and the water at the reaction surface are effective to cause the deployment device to melt a hole upwardly through the ice. Assuming the float tube 608 is sufficiently long relative to the ice thickness of the ice, the device will eventually break through the ice surface. When this occurs, the ice penetrator 610, which will no longer be attached to the float tube 608, is ejected from the tube by the spring 624, as shown in FIG. 23. This permits the antenna 612 to rise to its maximum height above the ice surface, as shown in FIG. 23. The device is so designed that in this final position, the antenna 612 projects above the ice a sufficient distance to assure effective signal transmission between the submarine and the remote communication stations. The bore 620 in the ice penetrator 610 is made sufficiently small and the tension member 622 is selected to be sufficiently flexible as to not interfer with upward passage of the ice penetrator 610 through the ice.

Figure 22:
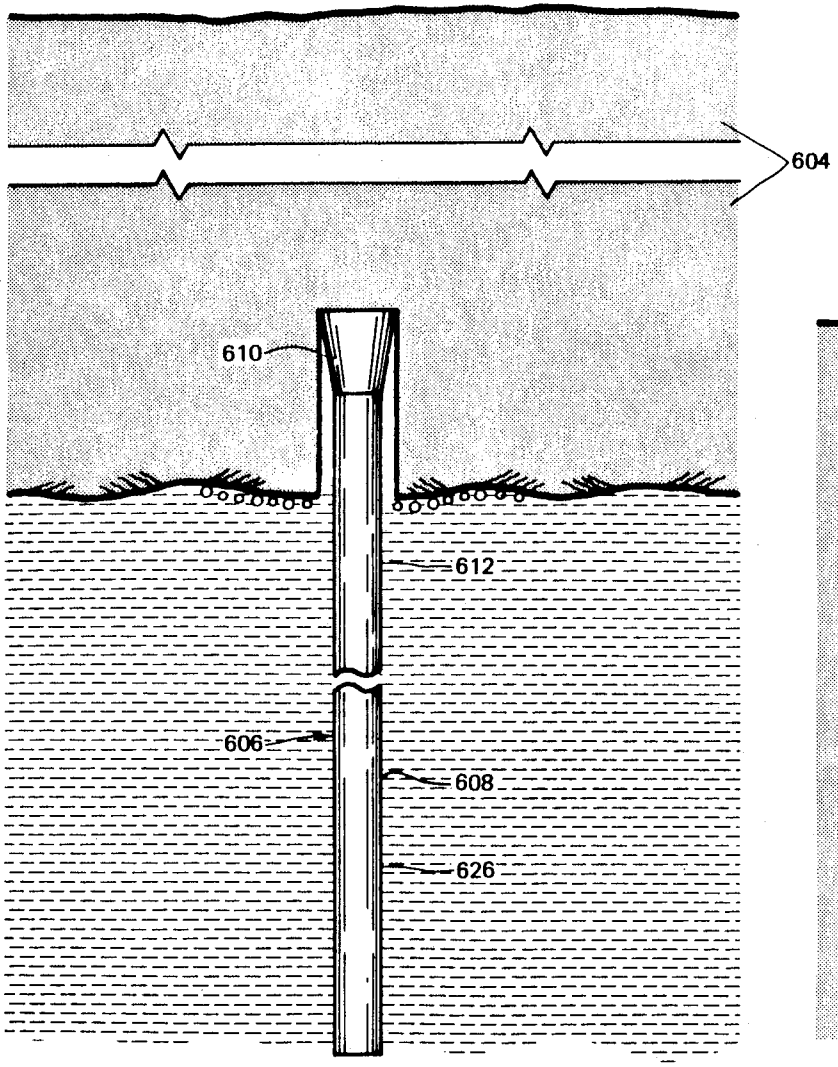
FIG. 22 illustrates the antenna device of the antenna deployment unit in an early ice penetration position.

At this point, it is important to mention that when the ice penetrator 610 is composed of lithium or other water reactive thermochemical material of the class noted earlier, the thermochemical reaction of the penetrator with water during its upward passage through the ice 604 generates a gas (hydrogen) which pressurizes the ice hole being formed by the penetrator and thereby keeps the hole from filling with water, as depicted in FIG. 22. This is advantageous for the reason that it avoids submersion of the ice penetrator in sea water which would dissipate the heat of the thermochemical reaction and thereby substantially retard and limit the penetration process. Upward ice penetration is therefore substantially more efficient and rapid than downward ice penetration in which the ice hole is flooded. This exclusion of sea water from the ice hole, however, reduces the length of the float tube 608 which is submerged in water, and hence the tube length which is effective to produce an upward buoyant force, to that lower end portion of the tube which projects below the ice. The effective length of this protecting lower end portion diminishes as the penetration device progresses upwardly through the ice. Unless it breaks through the ice surface, the device will continue to penetrate upwardly through the ice only until the weight of its upper end portion within the ice hole approximates the upward buoyant force on the lower end portion of the float tube which projects below the ice. If the device breaks through the ice surface, of course, the ice hole will fill with water, and the device will rise to its maximum height above the water, as shown in FIG. 23.

Figure 24:
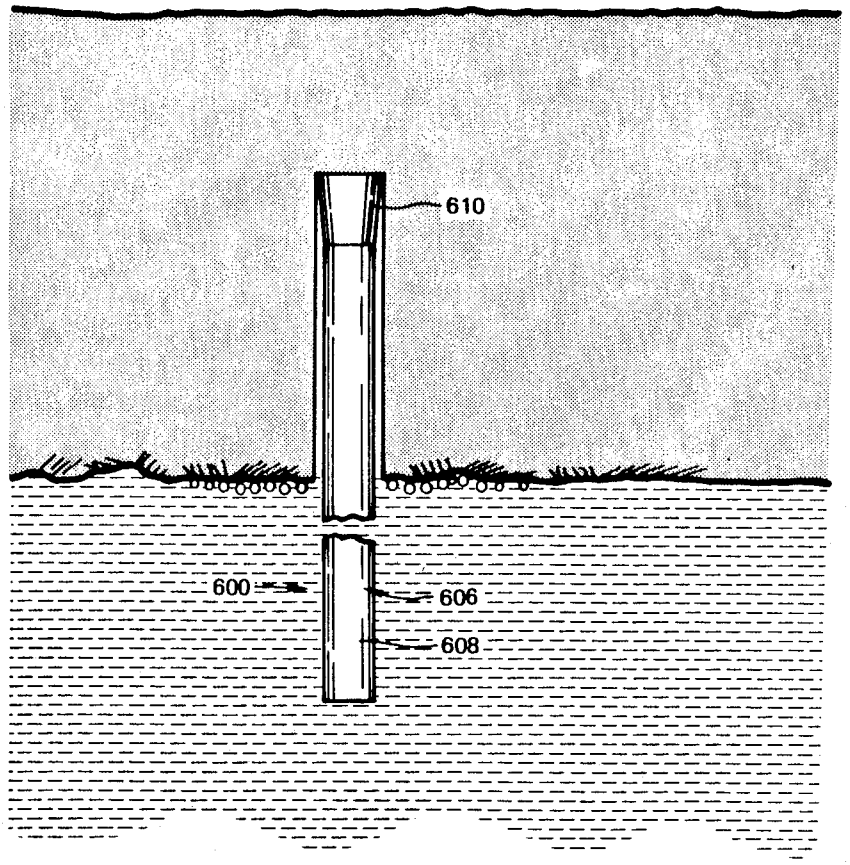
FIG. 24 illustrates an upward ice penetration device in final deployed position part way through the ice.
Figure 21:
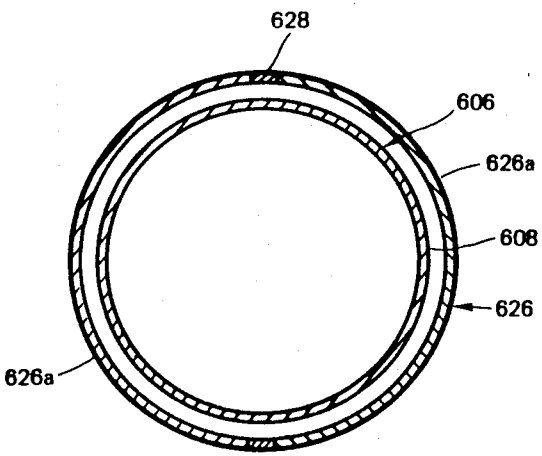
FIG. 21 is a transverse section of the antenna deployment unit of FIG. 20.

Accordingly, with a gas-generating reactant, the rigid float tube ice penetrating antenna 600 is only capable of completely penetrating ice whose thickness is less than the overall length of the float tube 608 by the minimum float tube length necessary to provide an effective upward buoyant ice penetration force on the device. In some applications, the device may be designed to penetrate only part way through the ice, as shown in FIG. 24. For this application, the ice penetrator 610 may be permanently attached to the float tube 608.

The antenna deployment unit 600 may be launched from the submarine 602 as a free body and contain a transmitter 634 for transmitting a prerecorded message or signal from the deployed antenna 612. Alternatively, the antenna may be connected by a wire to communication equipment on the submarine.

Figure 25:
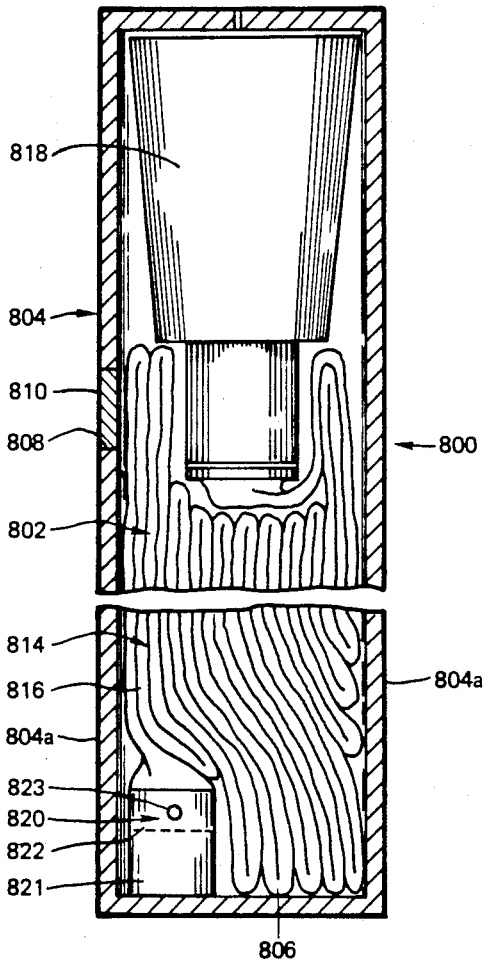
FIG. 25 is a longitudinal section through a modified submarine antenna deployment unit according to the invention in its pre-deployment stowage configuration.

The ice penetrating submarine antenna deployment unit 800 of FIG. 25 comprises an inflatable ice penetrating antenna device 802 and a hermetic container 804 for stowing the device until deployment. The storage container 804 is identical to that of FIG. 20 and hence need not be described in detail. Suffice it to say that the container 804 comprises two semi-cylindrical halves **804*a* joined by a water soluble seal 806. One half of the container has an opening 808 sealed by a water soluable plug 810**.

Antenna device 802 comprises an elongate body 814 including a normally lower inflatable float portion 816 and a normally upper thermogenic end portion or ice penetrator 818. The lower float portion 816 is an inflatable tube which is sealed at its upper end and is inflatable by pressurizing means 820 attached to its lower end to form an elongate tubular float similar to the float tube 608 of FIGS. 19–24. Like the latter float, the inflatable float tube 816 also forms an antenna and, to this end, may have a metallic coating or contain a conducting antenna element. When deflated, the tube 816 is foldable to a compact stowage configuration, as shown in FIG. 25.

The ice penetrator 818 of the antenna device 802 is a thermochemical ice penetrator like that of FIGS. 19–24. This ice penetrator is releasably attached to the upper end of the inflatable float tube 816 in the same manner as the ice penetrator of FIGS. 19–24 is attached to the float tube 608. The pressurizing means 820 is attached to the lower end of the float tube 816 aid includes a high pressure air cylinder 821 connected to the tube 816 through a normally closed valve 822. Valve 822 is operable to open position by sea pressure on an externally exposed actuator 823 to inflate the float tube.

Prior to deployment, the antenna deployment unit 800 is stowed on board a submarine with the antenna device 802 sealed within the container 804 with its inflatable tube 816 deflated and folded in the manner shown in FIG. 25. The deployment unit is launched from the submarine through a torpedo tube or flare tube depending on the dimensions of the container 804. Upon entering the sea water, the water soluable seal 806 and plug 810 start to erode and eventually are consumed by the sea water to release the container halves **804*a* for separation when the container is flooded through the port 808. Flooding of the container also exposes the valve actuator 822 to sea pressure to effect inflation of the float tube 816**.

The inflated antenna device 802 rises through the water until its ice penetrator 818 contacts the underside of the ice. The device then melts its way upwardly through the ice, utilizing the buoyancy of the inflated tube 816 as the upward penetration force. When the device breaks through the surface of the ice, the remaining portion of the penetrator 818 is ejected from the float tube to permit the antenna to rise to its maximum height above the ice.

This inflatable tube antenna device has the advantage of permitting containment of a relatively long float tube 816, in its deflated state, within a stowage container of a size which can be launched from a submarine. Thus, the float tube can be sized in length to penetrate relative thick ice, much thicker, for example, than that which the rigid float tube ice penetrator of FIGS. 19–24 can penetrate. At the lower end of the tube is a transmitter 824 which is activated, either immediately or through a time delay initiated, by sea pressure on the actuator 823, to transmit a pre-recorded message or signal from the deployed antenna. The pressurizing means 820, air cylinder 821, and transmitter 824 together with additional weight, if necessary, ballast the inflated antenna device to float upright.

Figure 26:
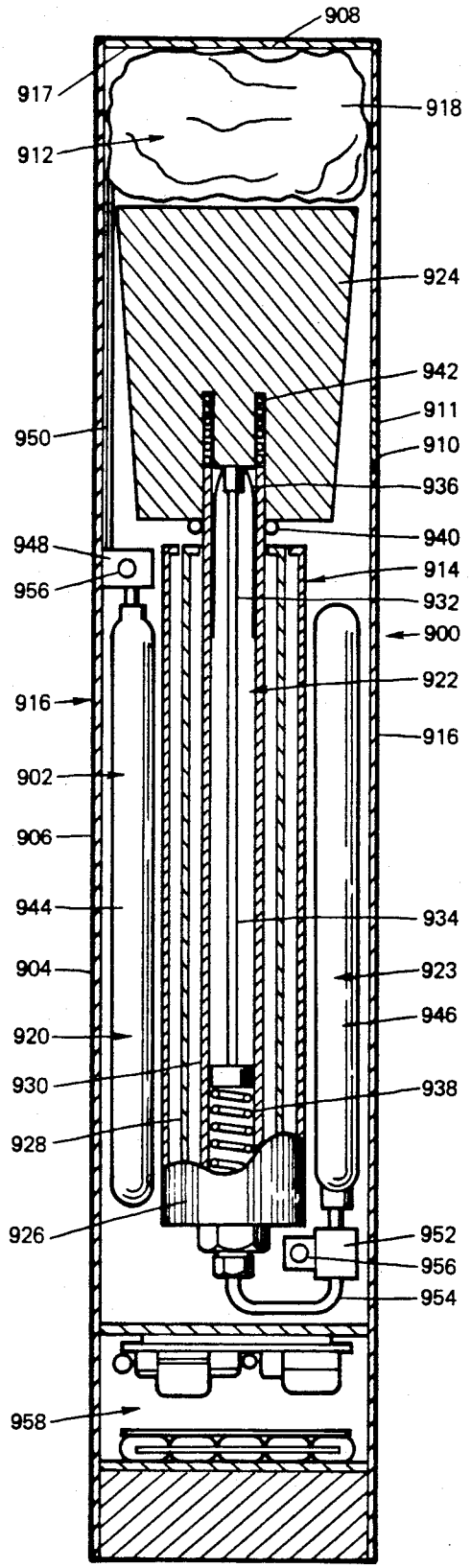
FIG. 26 is a longitudinal section through a further modified submarine antenna deployment system of the invention showing the system in its pre-deployment stowage configuration.
Figure 27:
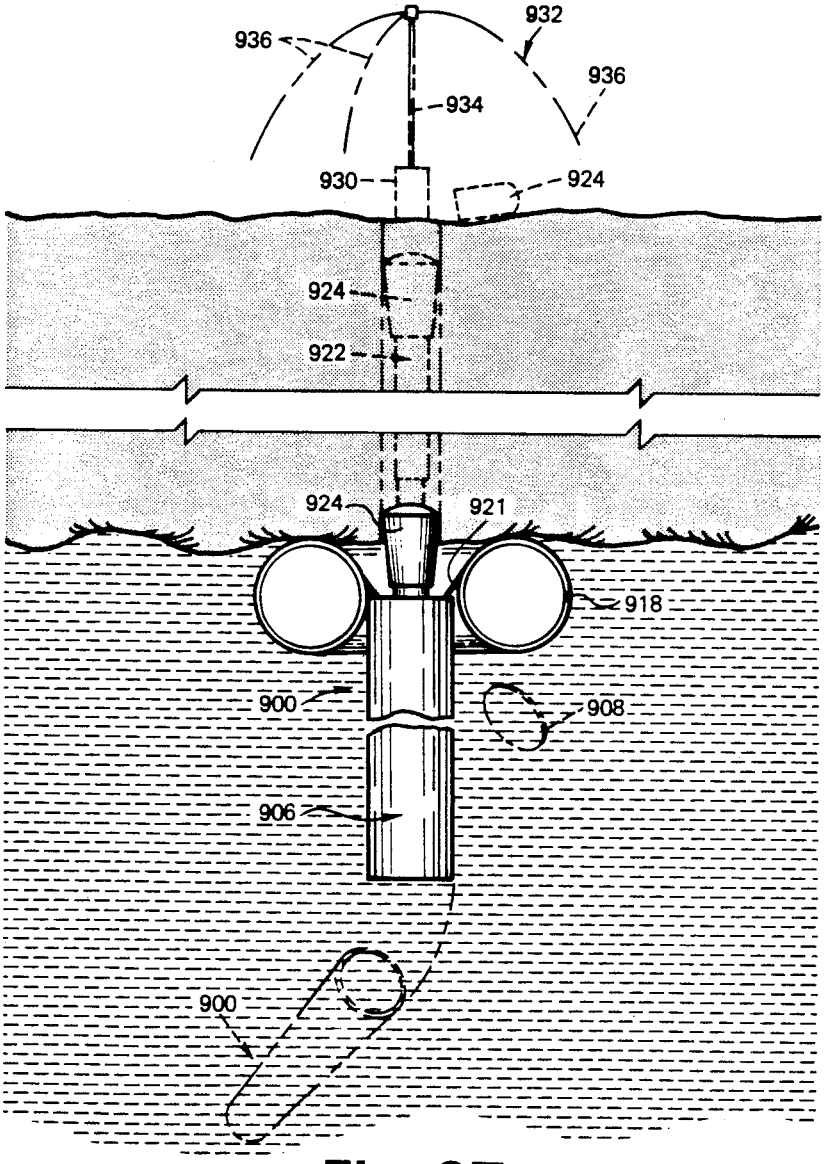
FIG. 27 illustrates, on reduced scale, the deployment sequence of the antenna deployment unit of FIG. 26.

The ice penetrating submarine antenna deployment unit 900 of FIGS. 26 and 27 comprises an upward ice penetrating antenna device 902 and a hermetic stowage container 904 for storing the device until deployment. Container 904 has a normally lower long slender cup-like canister 906 closed at its lower end by an integral end wall and at its upper end by a releasable cover 908. Cover 908 is tightly but removably mounted in the open upper end of the canister in such a way that the cover hermetically seals the canister and is ejectable from the container in the manner explained below. In the wall of the canister is an opening 910 closed by a water-soluable plug 911.

The antenna device 902 comprises flotation means 912 and extendable, ice penetrating antenna means 914 carried by the flotation means. Flotation means 912 comprises a flotation support 916 which includes the lower canister 906 of the stowage container 904 and an inflatable float 918 secured to the upper open end of the canister. The float illustrated is a toroidal float. When deflated, this float is adapted to be gathered and tucked into the top of the canister, as shown in FIG. 26. Mounted within the canister are pressurizing means 920 for inflating the float 918. The float is attached to the inside of the canister by an annular web 921 whose outer edge is secured to the inner perimeter of the float and whose inner edge is secured to the inner wall of the canister in such manner that the float is inflatable to its toroidal configuration of FIG. 27. When thus inflated, the float provides a sufficient positive buoyancy to enable the antenna deployment device 902 to penetrate upwardly through polar sea ice in the manner to be explained presently.

The extendable antenna means 914 comprises a pneumatic telescoping tube assembly 922 mounted within the canister 906 and pressurizing means 923 for extending the tube assembly. This tube assembly carries a thermal ice penetrator 924 and is extendable to extend the ice penetrator upwardly relative to the flotation support 916 when the float 918 is inflated. The extended length of the tube assembly from the top of the inflated float 918 to the ice penetrator 924 must be greater than the thickness of the ice to be penetrated by an amount equal to the desired deployed height of the antenna above the ice. This extended length of the tube assembly is dependent in part, of course, on the number of tubes in the tube assembly. Accordingly, the telescoping tube assembly must embody a sufficient number of telescoping tubes to achieve the required extended length.

For simplicity of illustration, the telescoping tube assembly 922 is shown to have only three telescoping tubes, namely, an outer tube 926, an intermediate tube 928, and an inner tube 930. These tubes are disposed in telescoping relation with suitable seals between the adjacent tubes. The outer tube 926 is firmly coaxially mounted in any convenient way within the canister 906. The canister and outer tube are sized so that an annular clearance space exists between them. The lower ends of the outer and inner tubes 926, 930 are closed by end walls. The lower end of the intermediate tube 928 is open. All three tubes are open at their upper ends.

Contained within the inner tube 930 is an antenna 932 including a plunger 934 which is slidable in the tube. Attached to the upper end of the plunger are a number of resilient antenna arms 936. These arms are bendable or foldable downwardly against the plunger 934 to their contracted positions of FIG. 26 to permit downward retraction of the antenna 932 into the inner tube 930, as shown. A compression spring 938 acting between the inner tube and the antenna urges the latter upwardly relative to the inner tube.

The ice penetrator 924 is a thermochemical ice penetrator whose lower end is recessed to slidably receive the upper end of the inner telescoping tube 930. The ice penetrator is releasably secured to the latter tube by a water soluable bond 940. A compression spring 942 is contained within an annular recess in the ice penetrator for ejecting the latter from the tube 930 as explained below.

The pressurizing means 920 for the float 918 and the pressurizing means 923 for the telescoping tube assembly 922 comprise high pressure air cylinders 944 and 946, respectively, mounted between the canister 906 and the tube assembly. Air cylinders 944 are connected to the float 918 through a pressure actuated valve 948 and air line 950. Air cylinders 946 are connected to the lower end of the tube assembly 922 through a pressure activated solenoid valve 952 and air line 954. Valves 948, 952 are normally closed and include actuators 956 which are exposed to and actuated by sea pressure to open the valves following deployment of the antenna deployment unit, as explained presently.

In the stowage condition of the antenna deployment unit 900, the telescoping tube assembly 922 is retracted into the canister 906, and the float 918 is deflated and tucked into the upper end of the canister on top of the ice penetrator 924, as shown in FIG. 26. The top of the canister is closed by its cover 908. The antenna deployment unit 900 is launched from a submarine through a torpedo or flare tube. Immediately, the sea water starts to dissolve the plug 911 which closes the flood opening 910 in the canister 906, and the canister is soon flooded through the opening. Flooding of the canister balances the pressure across the canister cover 908 and operates the float and telescoping tube pressurizing valves 948, 952. The float 918 then starts to inflate to its toroidal configuration of FIG. 27 and the tube assembly 922 starts to extend axially from the canister. Expansion of the float during its initial inflation forces the cover 908 from the canister, as shown in broken lines in FIG. 27. Continued inflation of the float expands the latter to its fully inflated toroidal configuration of FIG. 27. The positive buoyancy of the float causes the canister and float to rise to the position of FIG. 27 where the float seats against the underside of the overhead polar ice.

Continued extension of the tube assembly now urges the ice penetrator 924 upwardly against the ice to melt a hole through the ice. During this time, the ice penetrator 924 remains joined to the inner tube 930 of the tube assembly by the water soluable bond 940. This bond will be designed to dissolve and release the ice penetrator from the inner tube when the penetrator has penetrated some distance into the ice. After its release from the inner tube 930 by dissolution of the bond 940, the ice penetrator 924 remains caged between the inner tube and the ice so that the antenna deployment unit 900 continues to melt a hole upwardly through the ice. As explained previously, with some reactants the gas generated by the thermo-chemical reaction between the ice and ice penetrator prevents the ice hole from flooding with water, whereby the upward ice penetration speed is maximized. After the ice penetration 924 breaks through the ice surface, the remainder of the ice penetrator is ejected from the then extended inner telescoping tube 930 by the penetrating spring 942. This releases the antenna 932 for upward extension by its spring 938 to its broken line extended position of FIG. 27, wherein the antenna arms 936 extend outwardly to form an efficient antenna. Mounted within the canister is a pressure-activated transmitter 958 connected to the antenna 932 for transmitting a pre-recorded signal or message.

Figure 28:
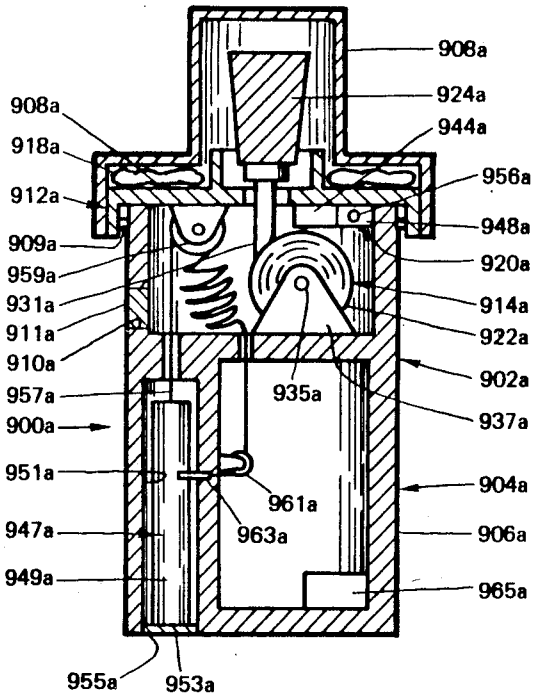
FIG. 28 is a section through a still further modified submarine antenna deployment unit of the invention in its predeployment stowage configuration.
Figure 29:
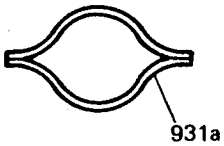
FIG. 29 is an enlarged section through the antenna tube in FIG. 28.
Figure 30:
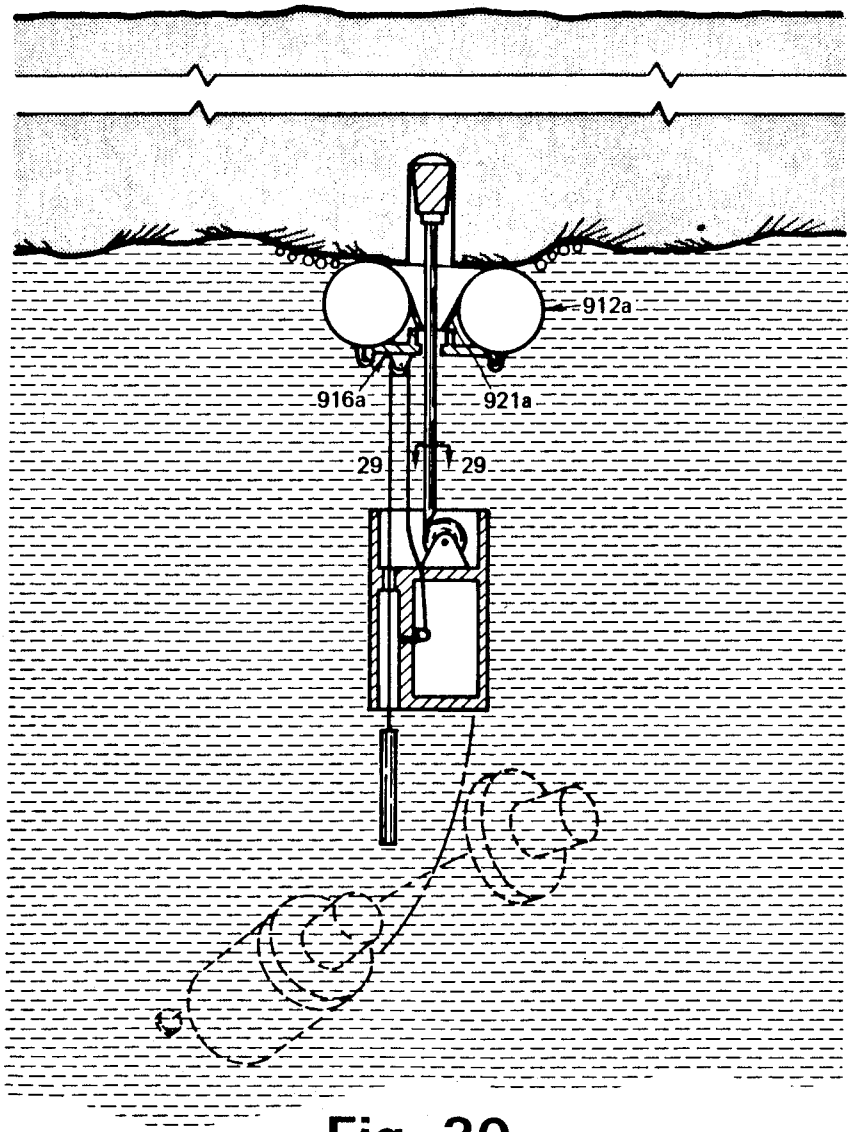
FIG. 30 illustrates the deployment sequence of the antenna deployment system of FIG. 28.

The ice penetrating submarine antenna deployment unit 900*a* of FIGS. 28–30 is functionally similar in many respects to that of FIGS. 26 and 27. For this reason, the parts of the unit of FIGS. 28–30 are designated by the same basic reference numerals as their functional counterparts in FIGS. 26, 27 but with the subscript a. Thus, the antenna deployment unit 900*a* comprises an upward ice penetrating antenna device 902*a* and a hermetic stowage container 904*a* for storing the device on board a submarine until deployment. This container includes a lower canister 906*a* and inner and outer covers 908*a*, 908*a'* releasably secured to the open top of the canister. Inner cover 908*a* is releasably secured to the canister 906*a* by a water soluable seal 909*a*. Outer cover 908*a* is releasably mounted over the inner cover 908*a* with a friction fit such that the outer cover is ejectable from the antenna deployment unit 900 after launch, as described below. Canister 906*a* has an opening 910*a* through which sea water may enter the canister to flood the latter. Prior to launch, this opening is close by a water soluable plug 911*a*.

The antenna device 902*a* includes a flotation means 912*a* and extendable ice penetrating antenna means 914*a* carried by the flotation means. Flotation means 912*a* comprises the inner cover 908 which forms a flotation support and an inflatable toroidal float 918*a*. Float 918*a* is coaxially secured about its inner circumference to the top or outer side of the inner cover 908*a* by an annular web 921*a*. When deflated, this float may be gathered and tucked on top of the inner cover to accommodate placement of the outer cover 908*a'* over the inner cover and deflated float. The outer cover is frictionally fitted over the inner cover in a manner which permits ejection of the outer cover by inflation of the float 918*a*, as explained later.

Mounted on the inner canister cover 908*a* are pressurizing means 920*a* for inflating the float 918*a* to its toroidal configuration of FIG. 30. When thus inflated, the float provides sufficient positive buoyancy to enable antenna deployment through polar sea ice in the manner explained presently. Pressurizing means 920*a* comprises a high pressure air cylinder 944*a* secured to the underside of the inner cover and connected to the float 918*a* through a pressure actuated valve 948*a*. This valve has an actuator 956*a* which is exposed to and actuated by sea pressure to open the valve following deployment of the unit 900*a*, as explained below.

The extendable antenna means 914*a* comprises a generally conventional extendable tube assembly 922*a* mounted within the canister 906*a*. This tube assembly includes a long tube 931*a* constructed of resiliently flexible material and having the crossection of FIG. 29 in its unstressed condition. The tube is adapted to be flattened and coiled, and when thus flattened and coiled, stores elastic strain energy which restores the tube to its straight tubular configuration when the tube is withdrawn from the coil. Tube 931*a* is flattened and wound into a coil on a spindle or drum 935*a* which is rotatably mounted by brackets 937*a* within the canister 906*a*. The outer end of the tube extends from the coil 933*a* upwardly through a central opening in the inner canister cover 908*a*. Mounted on the outer tube end is a thermochemical ice penetrator 924*a* like that shown in FIG. 20 and releasably secured to the tube in the same manner as the latter penetrator. The penetrator is larger than the cover opening through which the tube extends.

The extendable antenna means 914*a* also includes a gravity actuated means 947*a* for urging the ice penetrator 943*a* upwardly against the ice to effect penetration of the penetrator upwardly through the ice. This gravity actuated means embodies a weight 949*a* which is stored within a chamber 951*a* in the canister 906*a*. The lower end of this chamber opens through the bottom of the canister and is sealed by a releasable closure 953*a* which is peripherally secured to the canister by a water soluable seal 955*a*. A long cable 957*a* is secured at one end to the weight 949*a* and extends upwardly from the weight, around a pully 959*a* mounted on the underside of the inner canister cover 908*a* and then back down into the canister. The other end of the cable extends downwardly through the canister 906*a* alongside the chamber 951*a* and round a curved guide or pulley 961*a* to a spring-loaded latch pin 963*a*. This latch pin is spring biased into engagement with the weight 949*a* to retain the weight in the chamber. The latch pin is retractable to release the weight by tension in the cable. When thus retracted the latch pin anchors the adjacent cable end to the canister. Prior to deployment, a length of the cable is coiled within the canister as shown in FIG. 28.

In addition to supporting the ice penetrator 943*a*, the extendable tube 931*a* also serves as an antenna. To this end, the tube is either a metal or metal-coated plastic tube or contains an antenna wire extending the length of the tube.

Prior to deployment, the antenna deployment unit 900*a* occupies its storage configuration of FIG. 28 with the inner cover 908*a* in place on the canister 906*a* and the outer cover 908*a'* in position over the inner cover and deflated float 918*a*. The extendable antenna tube 931*a* is fully wound on the spindle 935*a*, and the weight 949*a* is locked within the canister chamber 951*a* by the latch pin 959*a*. The antenna deployment unit 900 is launched from a submarine through a torpedo tube or flare tube. Shortly after the unit enters the sea water, its water soluable plug 911*a* will be consumed. Sea water will then flood the canister 906*a* through its opening 910*a* and pressurize the actuator 956*a* of the float inflation valve 948*a*. This valve is thereby opened to inflate the toroidal float 918*a*. Initial expansion of this float during inflation ejects the outer canister cover 908*a'*, as depicted in broken lines in FIG. 30, to permit full inflation of the float to its toroidal configuration of the latter figure. As noted earlier, this float, when fully inflated, has sufficient water displacement volume to provide the positive buoyancy necessary for antenna deployment through the ice.

During this period of flooding of the canister 906*a* and inflation of the float 918*a*, the inner cover seal 909*a* is consumed to release the inner cover 908*a* for separation from the canister 906*a*. The cover then separates from the canister under the action of the opposing upward buoyant force and downward gravitational force on the cover and canister. The cover 906*a* (which then functions as a float platform) and the float 918*a* rise to the underside of the ice, while the canister with its contained weight 949*a* sinks. The seal 955*a* for the lower canister closure 953*a* is also consumed to release the closure from the canister. The weight 949*a* remains locked in position in the sinking canister by the latch pin 963*a* until the cable 957*a* becomes taut and retracts the latch pin to release the weight.

As noted earlier, the ice penetrator 924*a* is larger than the antenna tube opening in the inner canister cover 908*a*. Accordingly, separation of the latter cover and canister in the manner just described pulls or unwinds the antenna tube 931*a* from the spindle 935*a*, the upper ice penetrating end of the tube remaining essentially fixed relative to the inner cover. As it thus unwinds from the spindle, the tube, which is flattened while wound on the spindle, expands by elastic strain energy to its crossection of FIG. 29, thereby forming a relatively straight and rigid vertical pole-like member supporting at its upper end the ice penetrator 924*a*.

The antenna tube 931*a* and cable 957*a* are so sized in length that at the point of maximum separation of the cover 908*a* and canister 906*a*, which occurs when the cable becomes taut and prevents further separation, the unwound length of the tube is sufficient to permit penetration of the tube through and to a distance above the ice.

As noted above, at the point of maximum separation of the cover 908*a* and canister 906*a*, the cable 957*a* becomes taut to retract the latch pin 963*a* and thereby release the weight 949*a*. The mass of this weight exceeds substantially the mass of the canister 906*a* and all of its contents including the antenna tube 931*a* and ice penetrator 943*a*. Accordingly, when the weight is released by retraction of the latch pin 963*a*, the weight drops from the canister and acts as a counterweight which exerts an upward pull on the canister and thereby an upward thrust on the extended antenna tube 931*a*. This upward thrust, of course, produces a downward reaction force on the antenna tube tending to rotate the spindle 935*a* in a direction to rewind the tube on the spindle. This reverse rotation of the spindle is prevented by a ratchet mechanism or the like (not shown). Accordingly, the upward thrust exerted by the weight 949*a* on the antenna tube causes the ice penetrator 924*a* to gradually melt a hole upwardly through the ice as depicted in FIG. 30.

Eventually, the ice penetrator 924*a* will break through the ice surface. At this point, the ice penetrator is ejected from the antenna tube 931*a* in the manner described in connection with FIG. 20 to permit upward extension of the antenna tube 931*a* to its maximum height above the ice. Within the canister 904*a* is a pressure actuated transmitter 965*a* for transmitting a prerecorded message or signal from the deployed antenna.

We claim:

1. An ice penetration device comprising:

an elongate body including an ice penetrator, said ice penetrator having a longitudinally facing surface at one end of said body adapted to be urged against ice to be penetrated, and said ice penetrator comprising a solid mass of a reactant which reacts with $H_2O$ to liquify the ice adjacent said surface, whereby said ice penetrator is adapted to penetrate the ice, longitudinally of said body, and wherein said reactant mass is consumed lengthwise of said body by its reaction with $H_2O$, whereby the initial length of said reactant mass determines the maximum penetration distance of the device through the ice, and the initial length of said reactant mass may be selected to achieve a predetermined penetration distance.

2. The device of claim 1 wherein:

the cross-section of said body in any given transverse plane is at least as large as the cross-section of said body in every transverse plane between said given plane and the other end of said body.

3. The device of claim 1 wherein:

said ice penetrator is longitudinally tapered in a manner such that the cross-section of said penetrator in any given transverse plane exceeds the cross-section of said body in every transverse plane between said given plane and the other end of said body.

4. The device of claim 1 wherein:

said device is adapted to penetrate ice in the downward direction from its surface, and said body has an overall density greater than water whereby said end surface is urged downwardly against the ice by the force of gravity on said body.

5. The device of claim 1 wherein:

said reactant is a thermochemical material which reacts exothermally with water in contact with said surface to melt a hole through the ice.

6. The device of claim 4 wherein:

said reactant has a density less than water, said device is adapted to penetrate ice in the downward direction from its surface, and said body includes ballast which provides said body with an overall density greater than water, whereby said end surface is urged downwardly against the ice by the force of gravity on said body.

7. The device of claim 5 wherein:

said thermochemical material is an alkali metal or an alloy containing an alkali metal, such as lithium.

8. The device of claim 6 wherein:

said ballast is a weight.

9. The device of claim 6 wherein:

said ballast comprises a payload.

10. A thermal ice penetration device comprising:

an elongate body including a thermal ice penetrator at one end of the body, said ice penetrator having a longitudinally facing surface at said body end and including means for producing heat at said surface to melt the ice adjacent said surface, whereby said ice penetrator is adapted to melt a hole through the ice, longitudinally of said body, and wherein said device is adapted to penetrate polar ice in the upward direction from water below the ice and includes flotation means for urgining said ice penetrator upwardly against the ice.

11. The device of claim 10 wherein:

said flotation means comprises inflatable flotation means.

12. An ice penetration system for deploying a payload through ice, comprising:

an ice penetration device comprising an elongate body including an ice penetrator having a longitudinally facing surface at one end of said body adapted to be urged against the ice by a force on the body, and said ice penetrator comprising a solid reactant mass which reacts with $H_2O$ to liquify the ice adjacent said end surface, whereby said ice penetrator is adapted to penetrate through the ice in the endwise direction of said body to produce a hole through the ice, a payload associated with said ice penetrator for passage through said ice hole at least partially under the action of said force on the ice penetrator, and said reactant mass is consumed lengthwise of said body by its reaction with $H_2O$, whereby the initial length of said reactant mass determines the maximum penetration distance of the device thru the ice, and the initial length of said reactant mass may be selected to achieve a predetermined penetration distance.

13. The ice penetration system of claim 12 wherein:

said device is adapted to penetrate ice in the downward direction from its surface, and said body has an overall density greater than water whereby said end surface is urged downwardly against the ice by the force of gravity on said body.

14. A thermal ice penetration system for deploying a payload upwardly through ice, comprising:

a thermal ice penetration device comprising an elongate body including a thermal ice penetrator having a longitudinally facing end surface at one end of said body adapted to be urged against the ice by a force on the body, and means for producing heat at said end surface to melt the ice adjacent said end surface, whereby said ice penetrator is adapted to penetrate through the ice in the endwise direction of said body by melting a hole through the ice, a payload associated with said ice penetrator for passage through said ice hole at least partially under the action of said force on the ice penetrator, and wherein said device is adapted to penetrate polar ice in the upward direction from water below the ice and includes flotation means for urging said ice penetrator upwardly against the ice.

15. The ice penetration system of claim 12 wherein:

said ice penetrator is adapted to penetrate polar ice in the downward direction from its surface and includes a base to be stationarily positioned on the surface of said ice and a cable connecting said base, ice penetrator, and payload for suspending said payload in water below said ice.

16. The ice penetration system of claim 15 wherein:

said payload is separate from said ice penetration device and is connected by said cable to and between said device and said base.

17. A thermal ice penetration system for deploying a payload downwardly through ice from its surface, comprising:

a thermal ice penetration device comprising an elongate body including a thermal ice penetrator having a longitudinally facing end surface at one end of said body adapted to be urged downwardly against the ice by a force on the body, and means for producing heat at said end surface to melt the ice adjacent said end surface, whereby said ice penetrator is adapted to penetrate through the ice in the endwise direction of said body by melting a hole through the ice, a payload separate from said ice penetrator for passage through said ice hole at least partially under the action of said force on the ice penetrator, a base to be stationarily positioned on the surface of said ice, a cable connecting said base, ice penetrator, and payload with said payload situated between said base and said device for suspending said payload in water below said ice, and wherein said cable includes means for releasing said ice penetration device from said payload following entrance of the latter into the water below the ice.

18. The ice penetration system of claim 17 wherein:

said releasing means comprises a water soluable link.

19. A thermal ice penetration system for deploying a payload through ice, comprising:

a thermal ice penetration device comprising an elongate body including a thermal ice penetrator having a longitudinally facing end surface at one end of said body adapted to be urged against the ice by a force on the body, and means for producing heat at said end surface to melt the ice adjacent said end surface, whereby said ice penetrator is adapted to penetrate through the ice in the endwise direction of said body by melting a hole through the ice, a payload associated with said ice penetrator for passage through said ice hole at least partially under the action of said force on the ice penetrator, and wherein, said payload comprises an explosive weapon.

20. The ice penetration system of claim 19 wherein:

said ice penetrator comprises an integral thermogenic tip on said weapon.

21. A thermal ice penetration system for deploying a payload through ice, comprising:

a thermal ice penetration device comprising an elongate body including a thermal ice penetrator having a longitudinally facing end surface at one end of said body adapted to be urged against the ice by a force on the body, and means for producing heat at said end surface to melt the ice adajcent said end surface, whereby said ice penetrator is adapted to penetrate through the ice in the endwise direction of said body by melting a hole through the ice, a payload associated with said ice penetrator for passage through said ice hole at least partially under the action of said force on the ice penetrator, and wherein said payload comprises an instrument such as an antenna, sensor, transducer, sound or signal generator or the like.

22. A thermal ice penetration system for deploying a payload through ice, comprising:

a thermal ice penetration device comprising an elongate body including a thermal ice penetrator having a longitudinally facing end surface at one end of said body adapted to be urged against the ice by a force on the body, and means for producing heat at said end surface to melt the ice adjacent said end surface, whereby said ice penetrator is adapted to penetrate through the ice in the endwise direction of said body by melting a hole through the ice, a payload associated with said ice penetrator for passage through said ice hole at least partially under the action of said force on the ice penetrator, and wherein said payload comprises an instrument to be deployed with the ice penetrator to one side of the ice, and said system comprises a base to be positioned at the other side of said ice floe, and an electrical cable connecting said base and payload for transmitting electrical signals between said base and payload.

23. The ice penetration system of claim 22 wherein:

said base comprises a signal processor such as a transmitter, receiver, or the like, and said cable electrically connects said payload and signal processor.

24. The device of claim 1 including:

a cable attached at one end to the other end of said penetrator body, and means on said penetrator body for storing said cable and from which said cable may pay out, the other cable end first.

25. The device of claim 24 wherein:

said storage means comprises means for containing a coil of said cable.

26. The device of claim 1 including:

means on said body for yieldably bearing against the wall of the ice hole to provide a guidance action for guiding the device through the ice.

27. A thermal ice penetration device comprising:

an elongate body including a thermal ice penetrator having an end surface at one end of the body adapted to be urged against ice by a force acting on the body for melting a hole through the ice, and means on said body for yieldably bearing against the wall of the ice hole to provide a guidance action for guiding the device through the ice, and wherein said yieldable means comprise spring arms extending from the opposite end of said body.

28. The device of claim 27 wherein:

said ice penetrator tapers inwardly toward the longitudinal axis of said body in the direction of said opposite body end, whereby said penetrator has a maximum transverse cross-section at said end surface, and the radial spacing of the free end of each spring arm from said axis in the unstressed position of the arm exceeds the radial dimension of said maximum cross-section.

29. The device of claim 1 wherein:

said device is adapted to penetrate downwardly through ice by orienting said penetrator body in a generally upright position with said end surface lowermost and in contact with the ice, said device is adapted to occupy an initial prone position on the ice surface, and means on said body for reorienting the device from said initial position to said generally upright position.

30. The device of claim 29 wherein:

said reorienting means comprises means for causing the device to gradually assume an upright position as it descends through the ice.

31. The device of claim 29 wherein:

said device has a center of gravity, said reorienting means comprises a side surface of said reactant mass which extends endwise of said body from said end surface to a position beyond said center of gravity, whereby in said initial position of said device, said side surface contacts the ice to liquify the ice below said side surface and said device rotates to an upright position as it penetrates downwardly through the ice.

32. The device of claim 31 wherein:

said reactant mass includes a central core having said end surface, and an annular shell circumferentially surrounding said core and having said side surface.

33. The device of claim 32 wherein:

said core and shell comprise different reactant materials.

34. The device of claim 32 wherein:

said core and shell are consumed longitudinally of said body by reaction of the core and shell reactant materials with $H_2O$ at said end surface, and a water impervious barrier layer between said core and shell which erodes away adjacent said end surface as said core and shell are consumed longitudinally by reaction with $H_2O$.

35. The device of claim 29 wherein:

said reorienting means comprise means on said body engagable with the ice surface in said initial position of said device for supporting said body in an inclined altitude with the body sloping downward in the forward direction such that the device gradually assumes an upright position as it descends through the ice.

36. The device of claim 35 wherein:

said body supporting means comprises resilient arms extending rearwardly from the rear end of and spaced about said body.

37. The device of claim 36 wherein:

the cross-section of said penetrator in any given transverse plane exceeds the cross-section of said body in every transverse plane between said latter given plane and the other end of said body, and said resilient arms have normal unstressed positions wherein their free ends circumscribe an area greater than the cross-section of the front end of said body.

38. The device of claim 31 wherein, said reorienting means further comprise means on said body engagable with the ice surface in said initial position of said device for supporting said body in an inclined altitude with the body sloping downward in the forward direction such that the device gradually assumes an upright position as it descends through the ice.

39. A thermal ice penetration device comprising:

an elongate body including a thermal ice penetrator at one end of the body, said ice penetrator having a longitudinally facing surface at said body end and including means for producing heat at said surface to melt the ice adjacent said surface, whereby said ice penetrator is adapted to melt a hole through the ice, longitudinally of said body, and wherein said ice penetrator is composed of a thermochemical material which reacts exothermally with water and constitutes said heat producing means, and said material is consumed longitudinally at said reaction surface by said reaction, and a water impervious barrier layer covering the sides of said ice penetrator comprising a barrier material which erodes away adjacent said end surface as said thermochemical material is consumed by said reaction.

40. A thermochemical ice penetrator comprising:

a body of thermochemical material which reacts exothermally with water, said material having a reaction surface adapted to be urged against ice by a force on said body to effect exothermal reaction of said material with water at the interface between said reaction surface and the ice and thereby melting of the ice adjacent said surface by the heat of said reaction, whereby said ice penetrator is adapted to melt a hole through the ice, and means for heating said material upon initial contact of said reaction surface with the ice to initiate said reaction.

41. An ice penetration system comprising:

An ice penetration device having an elongate body including an ice penetrator at one end of said body adapted to be urged against ice to produce a hole through the ice, and means for generally vertically positioning said device with said ice penetrator in contact with the ice comprising an elongate hermetic housing for receiving said device with said ice penetrator situated adjacent one end of said housing, and a base at said housing end for resting on the ice with said housing upright, and said housing having at said one end an opening through which said ice penetrator engages the ice and a removable cover for said opening.

42. A thermal ice penetration system comprising:

a thermal ice penetration device having an elongate body including a thermal ice penetrator with a longitudinally facing surface at one end of said body adapted to be urged against ice and means for producing heat at said surface and thereby melting the ice adjacent said surface, whereby said ice penetrator is adapted to melt a hole through the ice, means for generally vertically positioning said device with said surface in contact with the ice, and wherein said device is adapted to penetrate upwardly through a polar ice floe and said positioning means comprises flotation means.

43. An ice penetration system comprising:

an ice penetration device adapted to be urged downwardly against polar ice by gravitational force for penetrating downwardly through the ice, and means for placing said device on the surface of the ice from an aircraft including a canister containing said device and adapted to be lowered or dropped from the aircraft onto the ice, and means for expelling said device from said canister onto the ice upon landing of the canister on the ice.

44. The ice penetration system of claim 43 wherein:

said canister provides a hermetic enclosure for storing and transporting said ice penetration device.

45. The ice penetration system of claim 43 including:

a payload associated with said ice penetration device for passage through said ice hole into water below the ice at least partially under the action of said force on the device.

46. The ice penetration system of claim 45 wherein:

said penetrator and payload comprise and integral body.

47. The ice penetration system of claim 45 wherein:

said payload is separate from said ice penetrator, and said ice penetration system includes a cable connecting said payload to said ice penetrator and said canister for suspending said payload in the water below said ice.

48. The ice penetration system of claim 47 wherein:

said payload comprises an electronic payload such as an underwater sensor, transducer, sound or signal generator or the like, said canister contains an electronic signal processor such as a transmitter, receiver, or the like, and said cable electrically connects said electronic payload and signal processor.

49. A thermal ice penetration device for melting a hole upwardly through floating ice such as a polar ice floe comprising:

a thermal ice penetrator having a surface to be urged against the ice and means for producing heat at said surface when in contact with ice, and flotation means mounting said ice penetrator for floating the latter in the water below the ice with said penetrator surface in contact with the ice in a manner such that the positive buoyancy of said flotation means urges said ice penetrator upwardly against the ice for melting hole upwardly through the ice.

50. The ice penetration device of claim 49 wherein:

said flotation means comprises a relatively rigid float.

51. The ice penetration device of claim 50 wherein:

said float comprises a hollow elongate tubular float mounting said ice penetrator at one end and ballasted to float generally vertically with said ice penetrator uppermost, and said penetrator surface faces longitudinally of said float.

52. The ice penetration device of claim 49 wherein:

said flotation means comprises an inflatable float.

53. The ice penetration device of claim 52 including:

means for pressurizing said float to inflate the float.

54. The ice penetration device of claim 49 wherein:

said flotation means comprises an inflatable tube mounting said ice penetrator at one end of the tube with said penetrator surface facing longitudinally of said tube.

55. The ice penetration device of claim 49 wherein:

said flotation means comprises a float, and said device further comprises means for extending said ice penetrator upwardly relative to said float.

56. The ice penetration device of claim 55 wherein:

said extending means comprises tube means having an upper end mounting said ice penetrator and operable from a compact storage condition to an upwardly extended condition, and means for extending said tube means from said storage condition to said extended condition.

57. The ice penetration device of claim 55 wherein:

said extending means comprises a support adapted to occupy an initial position below said float in the water, an elongate member extendable upwardly from said support and mounting said ice penetrator at the upper end of said member, and gravity actuated means operable between said float and support for elevating said support and thereby said member relative to said float.

58. The device of claim 49 wherein:

said ice penetrator is composed of a thermochemical material which reacts exothermally with water and forms said heat producing means.

59. The device of claim 58 wherein:

said thermochemical material is an alkali metal or an alloy containing an alkali metal, such as lithium.

60. A thermal ice penetrating unit to be carried by and launched from a submarine submerged below floating ice such as a polar ice floe, comprising:

a thermal ice penetrating device including a thermal ice penetrator adapted to be urged against the ice for melting a hole through the ice, and flotation means for buoyantly supporting said ice penetrator in contact with said floating ice in a manner such that the ice penetrator melts a hole upwardly through the floating ice, and means conditioning said device to be launched from the submarine.

61. The ice penetrating unit of claim 60 wherein:

said flotation means comprises a rigid float.

62. The ice penetrating unit of claim 60 wherein:

said flotation means comprises an inflatable float, and means for inflating said float.

63. The ice penetrating unit of claim 60 wherein:

said ice penetrating device is adapted to penetrate the full thickness of said floating ice from its underside to a final fully deployed position wherein the device protrudes through the upper ice surface, and said device includes an antenna which is exposed above the ice in said final deployed position.

64. The ice penetrating unit of claim 60 wherein:

said conditioning means comprises a hermetic storage container containing said penetration device for storage on and launching from the submarine, and means for releasing said penetration device from said container after launching of the unit from the submarine.

65. An ice penetration device for penetrating upwardly through floating ice such as a polar ice floe comprising:

an ice penetrator to be urged upwardly against the under side of the ice for producing a hole upwardly through the ice, and flotation means mounting said ice penetrator for floating the latter in the water below the ice with said penetrator in contact with the ice in a manner such that the positive buoyancy of said flotation means urges said ice penetrator upwardly against the ice for producing a hole upwardly through the ice.

66. The ice penetration device of claim 65 wherein:

said flotation means comprises a relatively rigid float.

67. The ice penetration device of claim 66 wherein:

said float comprises a hollow elongate tubular float mounting said ice penetrator at one end and ballasted to float generally vertically with said ice penetrator uppermost.

68. The ice penetration device of claim 65 wherein:

said flotation means comprises an inflatable float.

69. The ice penetration device of claim 68 including:

means for pressurizing said float to inflate the float.

70. The ice penetration device of claim 65 wherein:

said flotation means comprises an inflatable tube mounting said ice penetrator at one end of the tube.

71. The ice penetration device of claim 65 wherein:

said flotation means comprises a float, and said device further comprises means for elevating said ice penetrator upwardly relative to said float.

72. The ice penetration device of claim 71 wherein:

said elevating means comprises upwardly extendable means having an upper end mounting said ice penetrator and operable from a compact storage condition to an upwardly extended condition, and means for extending said extendable means from said storage condition to said extended condition.

73. The ice penetration device of claim 71 wherein:

said elevating means comprises a support adapted to occupy an initial position below said float in the water, an elongate member extendable upwardly from said support and mounting said ice penetrator at the upper end of said member, and gravity actuated means operable between said float and support for elevating said support and thereby said member relative to said float.

74. The ice penetration device of claim 65 including:

a payload associated with said ice penetrator for upward deployment through the ice with said ice penetrator.

75. An ice penetrating unit to be carried by and launched from a submarine submerged below floating ice such as a polar ice floe, comprising:

an ice penetrating device including an ice penetrator adapted to be urged against the ice for producing a hole through the ice, and flotation means for buoyantly supporting said ice penetrator in contact with the underside of said floating ice in a manner such that the ice penetrator forms a hole upwardly through the floating ice, and means conditioning said device to be launched from the submarine.

76. The ice penetrating unit of claim 75 wherein:

said flotation means comprises a rigid float.

77. The ice penetrating unit of claim 75 wherein:

said flotation means comprises an inflatable float, and means for inflating said float.

78. The ice penetrating unit of claim 75 wherein:

said conditioning means comprises a hermetic storage container containing said penetration device for storage on and launching from the submarine, and means for releasing said penetration device from said container after launching of the unit from the submarine.

79. The ice penetrating unit of claim 75 wherein:

said ice penetrating device includes an antenna and is adapted to penetrate said floating ice from its underside to a final position wherein said antenna is disposed in signal transducing relation to the atmosphere above the ice.

80. The ice penetrating unit of claim 79 including:

an electronic communication circuit coupled to said antenna.

81. The ice penetration device of claim 65 wherein:

said device includes an antenna associated with said ice penetrator and said ice penetrator is adapted to penetrate the ice from its underside to a final position wherein said antenna is disposed in signal transducing relation to the atmosphere above the ice.

82. The ice penetration device of claim 81 including:

an electronic communication circuit coupled to said antenna.

* * * * *